US009960523B2

(12) United States Patent
Kobayashi et al.

(10) Patent No.: US 9,960,523 B2
(45) Date of Patent: May 1, 2018

(54) MAT SEAL COVER OF WATERPROOF CONNECTOR

(71) Applicant: YAZAKI CORPORATION, Tokyo (JP)

(72) Inventors: Tooru Kobayashi, Shizuoka (JP); Hisaya Shibata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/135,600

(22) Filed: Apr. 22, 2016

(65) Prior Publication Data

US 2016/0315413 A1 Oct. 27, 2016

(30) Foreign Application Priority Data

Apr. 22, 2015 (JP) ..... 2015-087708
Apr. 22, 2015 (JP) ..... 2015-087709
Apr. 22, 2015 (JP) ..... 2015-087710

(51) Int. Cl.
*H01R 13/443* (2006.01)
*H01R 13/52* (2006.01)
*H01R 13/502* (2006.01)
*H01R 107/00* (2006.01)

(52) U.S. Cl.
CPC ..... *H01R 13/521* (2013.01); *H01R 13/443* (2013.01); *H01R 13/502* (2013.01); *H01R 13/5213* (2013.01); *H01R 2107/00* (2013.01)

(58) Field of Classification Search
CPC ... H01R 13/443; H01R 13/502; H01R 13/521
USPC ..... 439/274, 275, 279, 587
See application file for complete search history.

(56) References Cited

U.S. PATENT DOCUMENTS 4,944,688 A * 7/1990 Lundergan ..... H01R 13/5221 439/275
6,196,873 B1 * 3/2001 Murakami ..... H01R 13/502 439/595
7,270,556 B2 * 9/2007 Mori ..... H01R 13/5208 439/272

(Continued)

FOREIGN PATENT DOCUMENTS

JP 3-80985 U 8/1991
JP 2006-324161 A 11/2006

OTHER PUBLICATIONS

Japanese Office Action for the related Japanese Patent Application No. 2015-087708 dated Jul. 18, 2017.

*Primary Examiner* — Felix O Figueroa
(74) *Attorney, Agent, or Firm* — Kenealy Vaidya LLP

(57) ABSTRACT

In a mat seal cover of a waterproof connector, waterproof pins are provided inside through holes of the waterproof connector and are configured to close terminal insertion holes of a connector housing. The waterproof pins are retained in the through holes by pin retention portions. Coupling portions between the pin retention portions and inner circumferential walls of the through holes are disposed more closely to the front side in the pushing direction of the punching jig than abutment surfaces at rear ends of the waterproof pins against which the punching jig abuts, and rear end faces of the pin retention portions are inclined faces extending from the abutment surfaces toward the coupling portions and inclined to the front in the pushing direction of the punching jig.

7 Claims, 22 Drawing Sheets

(56) References Cited

U.S. PATENT DOCUMENTS 7,854,628 B2 * 12/2010 Chazottes ..... H01R 13/5208
439/587

* cited by examiner

MAT SEAL COVER OF WATERPROOF CONNECTOR

CROSS REFERENCE TO RELATED APPLICATIONS

This application is based on Japanese Patent Application (No. 2015-087708) filed on Apr. 22, 2015, Japanese Patent Application (No. 2015-087709) filed on Apr. 22, 2015 and Japanese Patent Application (No. 2015-087710) filed on Apr. 22, 2015, the contents of which are incorporated herein by reference.

BACKGROUND OF THE INVENTION

1. Field of the Invention

The present invention relates to a mat seal cover of a waterproof connector.

2. Description of the Related Art

As a waterproof connector in the related art, there is known a waterproof connector in which a mat seal (also referred to as a collective waterproof (rubber) stopper or the like) is attached to a rear portion of a connector housing having a plurality of terminal reception portions, and the mat seal has terminal insertion holes in positions corresponding to the terminal reception portions respectively. In this waterproof connector, when terminals are inserted into the terminal reception portions through the terminal insertion holes of the mat seal from the rear, the inner circumferences of the terminal insertion holes of the mat seal are brought into tight contact with the outer circumferences of electric wires extending rearward from the terminals. Thus, collective sealing can be attained between each electric wire and the connector housing.

In such a waterproof connector, "vacant terminal reception portions (vacant rooms)" meaning terminal reception portions to which no terminals are inserted may appear due to circuit specifications. When there appear vacant terminal reception portions, the terminal insertion holes of the mat seal in positions corresponding to the vacant terminal reception portions must be closed. In the related art, waterproof pins called dummy stoppers or the like are inserted into the terminal insertion holes of the mat seal so as to close the terminal insertion holes located in nonuse positions. However, when the number of vacant terminal reception portions increases, it takes much time and labor to insert the waterproof pins.

Therefore, waterproof pins corresponding to all the terminal insertion holes are provided integrally in advance in the mat seal cover which is made of synthetic resin and which will be attached to the rear side of the mat seal. Waterproof pins corresponding to terminal reception portions in use positions are punched out and removed by a punching jig pushed in, so that only the other waterproof pins corresponding to terminal reception portions in nonuse positions can be left behind (for example, see JP-A-2006-324161).

FIG. 20 is an exploded perspective view of a related-art waterproof connector provided with such a mat seal cover.

As shown in FIG. 20, this waterproof connector 501 has a connector housing 510 made of synthetic resin, a mat seal 520 made of rubber or soft resin, a mat seal cover 530 made of synthetic resin, a lever 550 made of synthetic resin, a packing 560, and a front holder 570. A plurality of terminals (not shown) are received in the connector housing 510 from the rear. The mat seal 520 is fitted to a rear portion of the connector housing 510. The mat seal cover 530 is fitted and fixed to the rear portion of the connector housing 510 so as to push the mat seal 520 from the rear side while preventing the mat seal 520 from coming off. The lever 550 is rotatably attached to the outside of the connector housing 510. The packing 560 is inserted into the inside of the connector housing 510 from the front. The front holder 570 is attached to a front portion of the connector housing 510.

The connector housing 510 has an inner housing 511 on the inner circumferential side and an outer housing 512 on the outer circumferential side thereof. The inner housing 511 includes a plurality of terminal reception portions 515 for receiving the terminals respectively. The outer housing 512 is a part that will be fitted to the outer circumference of a fitting cylindrical wall of a connector housing of a not-shown mating connector. The inner housing 511 is a part that will be fitted to the inner circumference of the fitting cylindrical wall of the connector housing of the mating connector. A rear end of the outer housing 512 is coupled with a rear end of the inner housing 511. In addition, a cylindrical wall portion (not shown) into which the mat seal 520 can be fitted is provided in a rear portion of the connector housing 510.

The mat seal 520 has a lip portion 522 in the outer circumference of a mat body 521. When the mat body 521 is fitted to the inner circumference of the cylindrical wall portion in the rear portion of the connector housing 510, the lip portion 522 can seal up a gap between the mat body 521 and the cylindrical wall portion. Terminal insertion holes 525 are formed in the mat body 521 so as to penetrate the mat body 521 in positions corresponding to the terminal reception portions 515 of the connector housing 510 respectively. When terminals are inserted into the terminal reception portions 515 through the terminal insertion holes 525 respectively in the state where the mat seal 520 has been attached to the rear portion of the connector housing 510, the inner circumferences of the terminal insertion holes 525 are brought into tight contact with the outer circumferences of electric wires extending rearward from the terminals respectively. Thus, the mat seal 520 can seal up gaps between the electric wires and the connector housing 510 collectively.

FIG. 21A include a perspective view and FIG. 21B includes a partially enlarged view of FIG. 21A, showing the configuration of the mat seal cover 530. FIG. 22 is a front view of the mat seal cover 530. FIG. 23 is a sectional view taken from the arrow direction D-D in FIG. 22. FIG. 23 shows a combination with a punching jig 1000. FIG. 24A is a partially enlarged view of FIG. 23. FIG. 24B is a similar view to FIG. 24A. FIG. 24B shows pin retention portions 534 and partition walls 533 of through holes 532 in a separate manner in order to explain them plainly. FIG. 25 is a schematic front view plainly showing the relationship among waterproof pins 535, the pin retention portions 534 and the through holes 532. FIG. 26 includes a front view of the mat seal cover and a partially enlarged view thereof. FIG. 26 shows a state in which a terminal has not been able to be smoothly inserted into a through hole 532 due to influence of burrs appearing in broken portions of pin retention portions 534.

As shown in FIG. 20, the mat seal cover 530 is disposed on the rear side of the mat seal 520 and engaged with the connector housing 510. Thus, the mat seal cover 530 can prevent the mat seal 520 from coming off and gives a pressing force to the mat seal 520 to thereby secure satisfactory sealing performance.

As shown in FIG. 21A to FIG. 25, the through holes 532 through which terminals can be inserted and electric wires can be extracted rearward are provided in the cover body 531 of the mat seal cover 530 made of a synthetic resin molded piece. The through holes 532 are located in positions corresponding to the terminal insertion holes 525 of the mat seal 520 respectively. In addition, the waterproof pins 535 are provided integrally inside all the through holes 532 through the pin retention portions 534 respectively.

Each waterproof pin 535 serves for closing a corresponding one of terminal insertion holes 525 of the mat seal 520 corresponding to, of the whole terminal reception portions 515 of the connector housing 510, terminal reception portions 515 located in nonuse positions. Each waterproof pin 535 is retained at two or more circumferential places of the waterproof pin 535 by breakable pin retention portions 534 built between the waterproof pin 535 and an inner circumferential wall 532*a* of a through hole 532. Particularly in this embodiment, as shown in FIG. 24B and FIG. 25, the pin retention portions 534 are coupled with the opposite side faces (inner circumferential wall of the through hole 532) of partition walls 533 between adjacent through holes 532.

In order to put the mat seal cover 530 into use, the waterproof pins 535 inside the through holes 532 corresponding to the terminal reception portions 515 located in use positions in the connector housing 510 are punched out and removed in advance by the punching jig 1000. That is, of the whole terminal reception portions 515 of the connector housing 510, some terminal reception portions 515 may be located in nonuse positions. In this case, as shown in FIG. 22 to FIG. 24B, punching pins 1001 of the punching jig 1000 are pushed in from the rear to thereby break the pin retention portions 534. Thus, extruding the waterproof pins 535 corresponding to the terminal reception portions 515 located in nonuse positions, the waterproof pins 535 corresponding to the terminal reception portions 515 located in use positions are punched out and removed.

Incidentally, although the punching pins 1001 corresponding to the whole waterproof pins 535 are provided in the punching jig 1000 shown in FIG. 23 to FIG. 24B, a punching jig 1000 provided with punching pins 1001 only in required positions is used in fact.

However, when a waterproof pin 535 is punched out by the punching jig 1000, burrs 534*p* may appear in broken portions of pin retention portions 534 as shown in FIG. 26. The burrs 534*p* may project into a space where a terminal 503 attached to a front end of an electric wire will be inserted. When the terminal 503 is inserted into the through hole 532 where the waterproof pin 535 has been punched out, the burrs 534*p* may become an obstacle. For example, the burrs 534*p* may be an obstacle to make it difficult to insert the terminal 503 itself or fragments separated from the burrs 534*p* may adhere to the terminal 503 inserted thereto. Thus, a contact failure may be caused. Such a product must be dealt with as a defective product in spite of the small burrs 534*p*. As a result, there is a fear that the yield may deteriorate.

In addition, as shown in FIG. 23 to FIG. 24B, the pin retention portions 534 of the waterproof pins 535 in the related art are provided in the same position with respect to a punching direction X. That is, as shown in FIG. 25, each waterproof pin 535 is retained by two pin retention portions 534 disposed in the array direction of the through holes 532 and another pin retention portion 534 disposed at another place. Those pin retention portions 534 are disposed in positions arranged on one and the same line L in the punching direction X of the punching jig 1000, as shown in FIG. 23 to FIG. 24B.

However, when the pin retention portions 534 are disposed in the same position with respect to the punching direction X, breaking loads acting on pin retention portions 534 when adjacent waterproof pins 535 are punched out concentrate on the same place of a partition wall 533 (see FIG. 25) between through holes 532 and at the same timing. Thus, there is a fear that there may occur a failure in which the partition wall 533 comes off together with the waterproof pins 535.

SUMMARY OF THE INVENTION

The present invention has been developed in consideration of the aforementioned circumstances. A first object of the invention is to provide a mat seal cover in which, even if burrs occur in broken portions of pin retention portions when a punching jig is pushed in to break the pin retention portions and the waterproof pins are punched out, terminals are not affected from the burrs but can be inserted into through holes from which waterproof pins have been punched out.

In addition, a second object of the invention is to provide a mat seal cover in which concentration of breaking loads on each partition wall between through holes when adjacent waterproof pins are punched out can be relaxed so that the partition wall can be prevented from being damaged.

The aforementioned objects of the invention are attained by the following configurations.

(1) A mat seal cover of a waterproof connector, including:

a plurality of through holes that correspond to terminal insertion holes of a mat seal corresponding to terminal reception portions of a connector housing;

waterproof pins provided inside the through holes and configured to close the terminal insertion holes; and breakable pin retention portions provided between the waterproof pins and inner circumferential walls of the through holes so as to bridge gaps therebetween, wherein the waterproof pins are retained in the through holes by the pin retention portions and the waterproof pins corresponding to the terminal reception portions located in use positions are configured to be punched and removed when the pin retention portions are broken by a punching jig pushed in from the rear; and wherein coupling portions between the pin retention portions and the inner circumferential walls of the through holes are disposed more closely to the front side in the pushing direction of the punching jig than abutment surfaces at rear ends of the waterproof pins against which the punching jig abuts, and rear end faces of the pin retention portions are inclined faces extending from the abutment surfaces toward the coupling portions and inclined to the front in the pushing direction of the punching jig.

(2) A mat seal cover of a waterproof connector according to the aforementioned configuration (1), wherein, of a pre-shear breaking surface of each of the coupling portions between the pin retention portions and the inner circumferential walls of the through holes, a front end in the pushing direction of the punching jig is formed into a pointed end shape pointed to the front in the pushing direction.

(3) A mat seal cover of a waterproof connector according to the aforementioned configuration (1), wherein the pin retention portions retaining adjacent ones of the waterproof pins are disposed to be displaced from each other in the pushing direction of the punching jig.

(4) A mat seal cover of a waterproof connector according to the aforementioned configuration (1), wherein the coupling portions between the pin retention portions and the inner circumferential walls of the through holes are disposed in bottom faces of concave portions provided in the inner circumferential walls of the through holes.

According to the mat seal cover having the aforementioned configuration (1), the coupling portions between the pin retention portions and the inner circumferential walls of the through holes are disposed more closely to the front side than the jig abutment surfaces of the waterproof pins, and rear end faces of the pin retention portions are inclined faces extending from the jig abutment surfaces toward the coupling portions and inclined to the front. Due to the configuration, when the waterproof pins are punched out by the punching jig, stress is controlled to concentrate on the rear ends of the coupling portions between the pin retention portions and the inner circumferential walls of the through holes so that shear breaking can start at the rear end positions. Thus, the start points of the shear breaking are defined at the rear ends of the coupling portions so that burrs generated in the broken portions can be reduced.

According to the mat seal cover having the aforementioned configuration (2), the final position of shear breaking occurring in the pre-shear breaking surface of each of the coupling portions between the pin retention portions and the inner circumferential surfaces of the through holes is defined at the front end formed into a pointed end shape. Thus, the finally broken place can be made as small as possible, and burrs are hardly generated.

According to the mat seal cover having the aforementioned configuration (3), the pin retention portions of adjacent ones of the waterproof pins are displaced from each other in the front/rear direction (the pushing direction of the punching jig). Accordingly, breaking loads applied to the pin retention portions when the adjacent waterproof pins are punched out act on a partition wall between through holes at positions displaced from each other and at timings shifted from each other. Thus, a peak load with which the waterproof pins are punched out is reduced so that the partition wall between the through holes adjacent to each other can be prevented from being damaged by the load.

According to the mat seal cover having the aforementioned configuration (4), some burrs may survive in the broken portions of the pin retention portions when the pin retention portions are broken by the punching jig pushed therein to thereby punch out the waterproof pins. However, the surviving burrs causes no interference with insertion of terminals into the through holes of the mat seal cover as long as the burrs are put within depth of each concave portion. That is, there are no obstructive foreign substances (burrs) in the spaces to which the terminals should be inserted. Thus, the terminals can be inserted smoothly. In addition, there is no fear that the terminals to be inserted may touch the burrs. Accordingly, there is no fear that fragments of the burrs may be caught by the terminals, causing a contact failure. Products having some burrs do not have to be dealt with as defective products. Thus, the configuration can contribute to improvement in yield.

According to the invention, burrs hardly occur in the broken portions of the pin retention portions when the pin retention portions are broken by the punching jig pushed in to thereby punch out the waterproof pins. It is therefore possible to smoothly insert terminals into the through holes from which the waterproof pins have been punched out. In addition, the terminals to be inserted can be prevented from touching the burrs. Therefore, products having the burrs do not have to be dealt with as defective products. The invention can contribute to improvement in yield.

According to the invention, breaking loads applied to the pin retention portions when the waterproof pins adjacent to each other act on a partition wall between the through holes at positions displaced from each other and at timings shifted from each other. Therefore, a peak load with which the waterproof pins are punched out is reduced so that the partition wall between the through holes adjacent to each other can be prevented from being damaged by the load.

According to the invention, some burrs may survive in the broken portions of the pin retention portions when the pin retention portions are broken by the punching jig pushed in to thereby punch out the waterproof pins. However, terminals can be inserted smoothly in spite of the surviving burrs. In addition, the terminals to be inserted can be prevented from touching the burrs. Therefore, products having some burrs do not have to be dealt with as defective products. The invention can contribute to improvement in yield.

The invention has been described briefly. Further, the details of the invention will be made clearer through the following mode for carrying out the invention (hereinafter referred to as "embodiment") with reference to the accompanying drawings.

BRIEF DESCRIPTION OF THE DRAWINGS

FIG. 7 is a side sectional view showing a state in which a waterproof pin is being punched out by a punching pin of a punching jig pushed in.

DETAILED DESCRIPTION OF THE EXEMPLARY EMBODIMENTS

A first embodiment of the invention will be described below.

Figure 1:
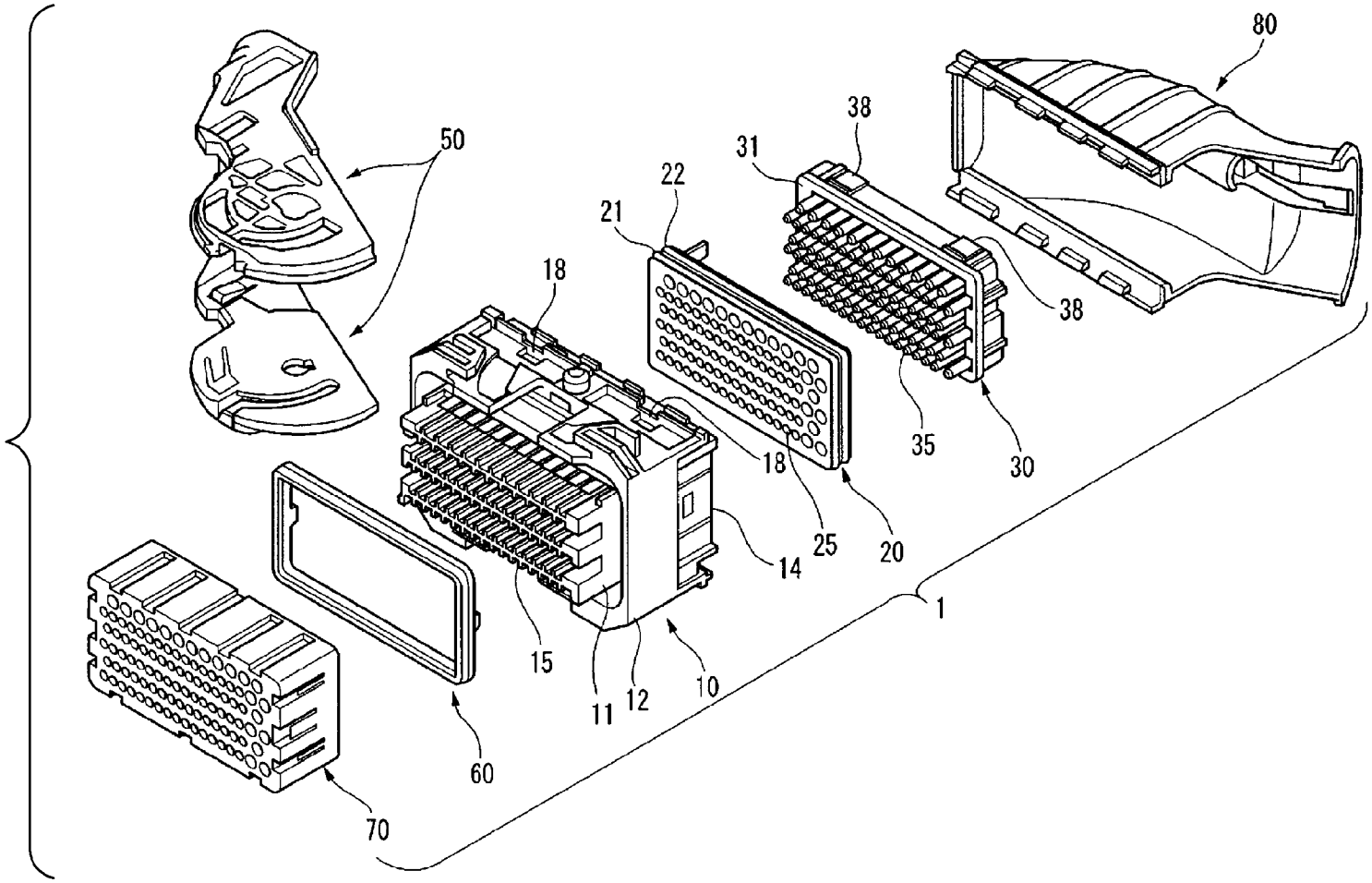
FIG. 1 is an exploded perspective view of a waterproof connector using a mat seal cover according to a first embodiment of the invention.

FIG. 1 is an exploded perspective view of a waterproof connector using a mat seal cover according to the embodiment.

As shown in FIG. 1, this waterproof connector 1 includes a connector housing 10 made of synthetic resin, a mat seal 20 made of rubber or soft resin, a mat seal cover 30 made of synthetic resin, a lever 50 made of synthetic resin, a packing 60, a front holder 70, and an electric wire cover 80. A plurality of terminals (not shown) are received in the connector housing 10 from the rear. The mat seal 20 is fitted to a rear portion of the connector housing 10. The mat seal cover 30 is fitted and fixed to the rear portion of the connector housing 10 so as to push the mat seal 20 from the rear side while preventing the mat seal 20 from coming off. The lever 50 is rotatably attached to the outside of the connector housing 10. The packing 60 is inserted into the inside of the connector housing 10 from the front. The front holder 70 is attached to a front portion of the connector housing 10. The electric wire cover 80 is attached to the rear side of the mat seal cover 30.

The connector housing 10 includes an inner housing 11 disposed on the inner circumferential side, an outer housing 12 disposed on the outer circumferential side of the inner housing 11, and a cylindrical wall portion 14 disposed on the rear side of the inner housing 11 and the outer housing 12. The inner housing 11 has a plurality of terminal reception portions 15 for receiving terminals respectively. The mat seal 20 is fitted to the cylindrical wall portion 14. The outer housing 12 is a part that will be fitted to the outer circumference of a fitting cylindrical wall of a connector housing of a not-shown mating connector. The inner housing 11 is a part that will be fitted to the inner circumference of the fitting cylindrical wall of the connector housing of the mating connector. A rear end of the outer housing 12 is coupled with a rear end of the inner housing 11 and a front end of the cylindrical wall portion 14.

The mat seal 20 has a lip portion 22 in the outer circumference of a mat body 21. When the mat body 21 is fitted to the inner circumference of the cylindrical wall portion 14 in the rear portion of the connector housing 10, the lip portion 22 can seal up a gap between the mat body 21 and the cylindrical wall portion 14. Terminal insertion holes 25 are formed in the mat body 21 so as to penetrate the mat body 21 in positions corresponding to the terminal reception portions 15 of the connector housing 10 respectively. When terminals are inserted into the terminal reception portions 15 through the terminal insertion holes 25 respectively in the state where the mat seal 20 has been fitted to the inner circumference of the cylindrical wall portion 14 in the rear portion of the connector housing 10, the inner circumferences of the terminal insertion holes 25 are brought into tight contact with the outer circumferences of electric wires extending rearward from the terminals respectively. Thus, the mat seal 20 can seal up gaps between the electric wires and the connector housing 10 collectively.

Figure 2A:
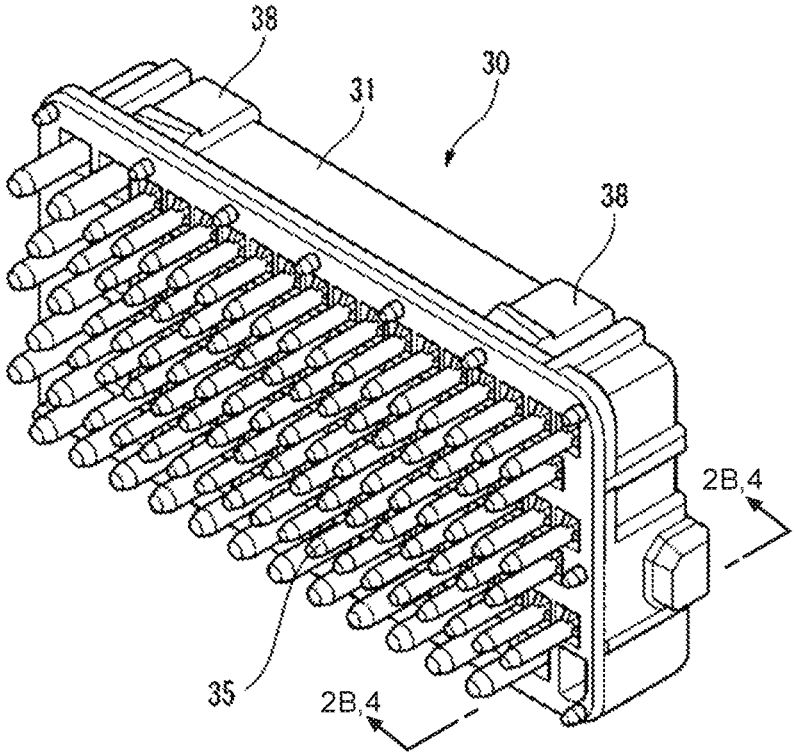
FIG. 2A is a perspective view of the mat seal cover.
Figure 2B:
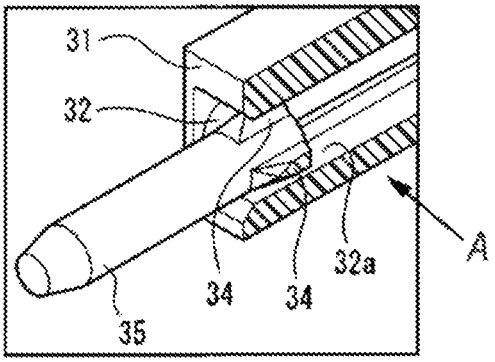
FIG. 2B is a partial perspective cross-sectional view taken along arrow 2B,4-2B,4 in FIG. 2A and enlarged.
Figure 3:
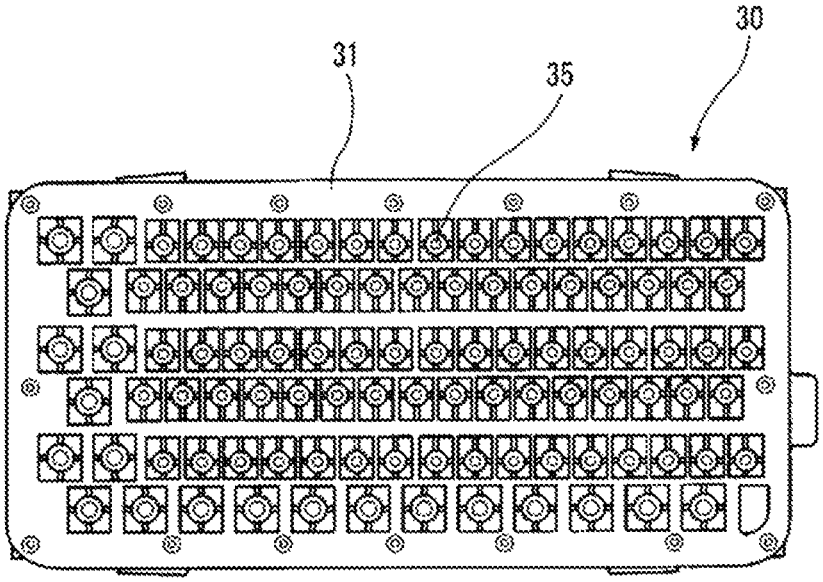
FIG. 3 is a front view of the mat seal cover.
Figure 4:
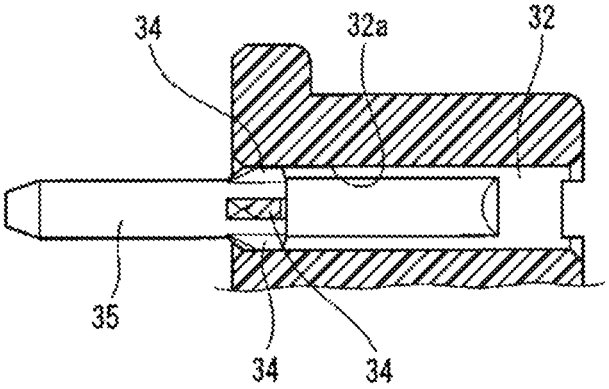
FIG. 4 is a cross-sectional view taken along arrow 2B,4-2B,4 in FIG. 2A and a plan view of FIG. 2B in the direction of the arrow A in FIG. 2B.
Figure 5:
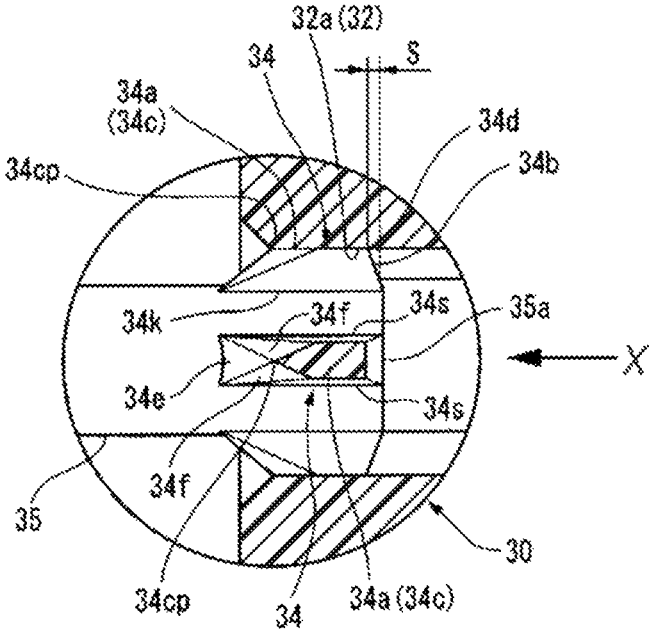
FIG. 5 is a main portion enlarged view of FIG. 4.
Figure 6:
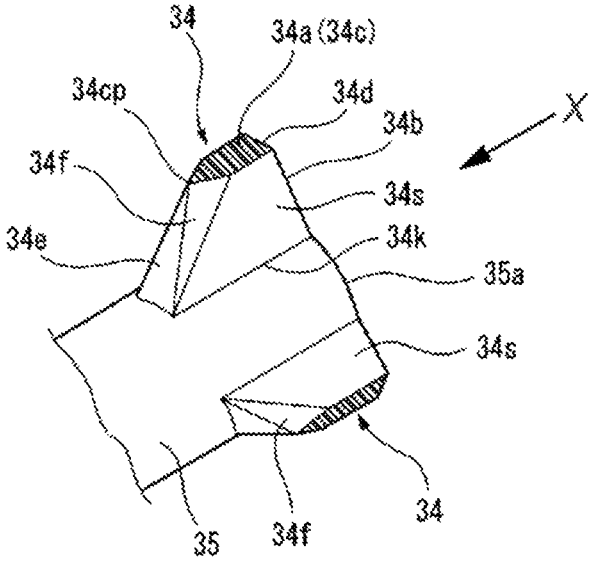
FIG. 6 is a perspective view of the portion shown in FIG. 5.

FIG. 2A is a perspective view of the mat seal cover, and FIG. 2B is a partial perspective cross-sectional view taken along arrow 2B,4-2B,4 in FIG. 2A and enlarged. FIG. 3 is a front view of the mat seal cover. FIG. 4 is a cross-sectional view taken along arrow 2B,4-2B,4 in FIG. 2A and a plan view of FIG. 2B in the direction of arrow A in FIG. 2B. FIG. 5 is a main portion enlarged view of FIG. 4. FIG. 6 is a perspective view of the portion shown in FIG. 5.

The mat seal cover 30 is disposed on the rear side of the mat seal 20 as shown in FIG. 1. When lock portions 38 of the mat seal cover 30 are engaged with lock portions 18 of the connector housing 10, the mat seal cover 30 can prevent the mat seal 20 from coming off and perform a function for giving a pressing force to the mat seal 20 to thereby secure satisfactory sealing performance.

Figure 7:
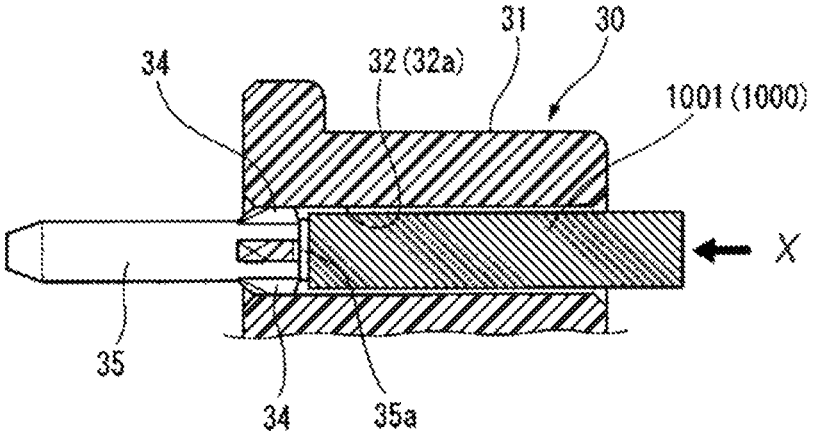

As shown in FIG. 2A to FIG. 6, through holes 32 to which terminals can be inserted and from which electric wires can be extracted toward the rear are provided in the cover body 31 of the mat seal cover 30 made of a synthetic resin molded piece. The through holes 32 are located in positions corresponding to the terminal insertion holes 25 of the mat seal 20 respectively. Waterproof pins 35 are provided in all the through holes 32 respectively and integrally thereto through pin retention portions 34. As shown in FIG. 7, each through hole 32 includes a pair of openings, one at each end face of the mat seal cover 30.

Each waterproof pin 35 serves for closing a corresponding one of terminal insertion holes 25 of the mat seal 20 corresponding to, of the whole terminal reception portions 15 of the connector housing 10, terminal reception portions 15 located in nonuse positions. Each waterproof pin 35 is retained at two or more circumferential places of the waterproof pin 35 by breakable pin retention portions 34 built between the waterproof pin 35 and an inner circumferential wall 32*a* of a through hole 32. In this embodiment, the pin retention portions 34 are provided at four circumferential places of the waterproof pin 35 (at four left, right, upper and lower places of the waterproof pin 35 in view from the front).

Each waterproof pin 35 is provided to project in front of the cover body 31, and supported by four pin retention portions 34 in a position near the rear end thereof. As shown in FIG. 5 and FIG. 6, each pin retention portion 34 is formed as a small plate-like piece having opposite side faces 34*s* substantially parallel to a pushing direction X of a punching jig 1000. A coupling portion 34*a* between each pin retention portion 34 and an inner circumferential wall 32*a* of a through hole 32 is disposed more closely to the front side in the pushing direction X of the punching jig 1000 than an abutment surface 35*a* at a rear end of a waterproof pin 35 against which the punching jig 1000 abuts. A rear end face 34*b* of the pin retention portion 34 is an inclined face extending from the abutment surface 35*a* toward the coupling portion 34*a* and inclined to the front in the pushing direction X of the punching jig 1000. That is, a rear end 34*d* of the coupling portion 34*a* is located more closely to the front side than the abutment surface 35*a* by a distance s.

Incidentally, the opposite side faces 34*s* of the pin retention portion 34 are slightly inclined with respect to the radial direction of the waterproof pin 35 so that the distance between the opposite side faces 34*s* can be reduced as it goes from a coupling portion 34*k* with the waterproof pin 35 toward the coupling portion 34*a* with the inner circumferential wall 32*a* of the through hole 32.

In addition, a front end face 34*e* of the pin retention portion 34 is formed as a slope inclined rearward as it goes from the coupling portion 34*k* with the waterproof pin 35 toward the coupling portion 34*a* with the inner circumferential wall 32*a* of the through hole 32. In addition, slopes 34*f* are formed in ridge portions in which the front end face 34*e* of the pin retention portion 34 intersects the opposite side faces 34*s* respectively. The front end face 34*e* of the pin retention portion 34, the two slopes 34*f* and a pre-shear breaking surface 34*c* of the coupling portion 34*a* intersect at one point. Thus, of the pre-shear breaking surface 34*c* of the coupling portion 34*a* between the pin retention portion 34 and the inner circumferential wall 32*a* of the through hole 32, a front end 34*cp* in the pushing direction X of the punching jig 1000 is formed into a pointed end shape pointed to the front in the pushing direction X, or particularly into a shape having an acute angle.

When the mat seal cover 30 is used, the waterproof pins 35 in the through holes 32 corresponding to the terminal reception portions 15 in use positions in the connector housing 10 are punched out and removed in advance by the punching jig 1000. That is, of the whole terminal reception portions 15 of the connector housing 10, some terminal reception portions 15 may be located in nonuse positions. In this case, as shown in FIG. 7, punching pins 1001 of the punching jig 1000 are pushed in from the rear to thereby break the pin retention portions 34. Thus, extruding the waterproof pins 35 corresponding to the terminal reception portions 15 located in nonuse positions, the waterproof pins 35 corresponding to the terminal reception portions 15 located in use positions are punched out and removed. On this occasion, breaking in each pin retention portion 34 is controlled to occur along a boundary surface between the coupling portion 34*a* between the pin retention portion 34 and the inner circumferential wall 32*a* of the through hole 32 and the inner circumferential wall 32*a* of the through hole 32. The boundary surface is herein referred to as the pre-shear breaking surface 34*c*. The wavy line in FIG. 8 virtually shows the state in which breaking occurs in the pre-shear breaking surface 34*c*.

Figure 8:
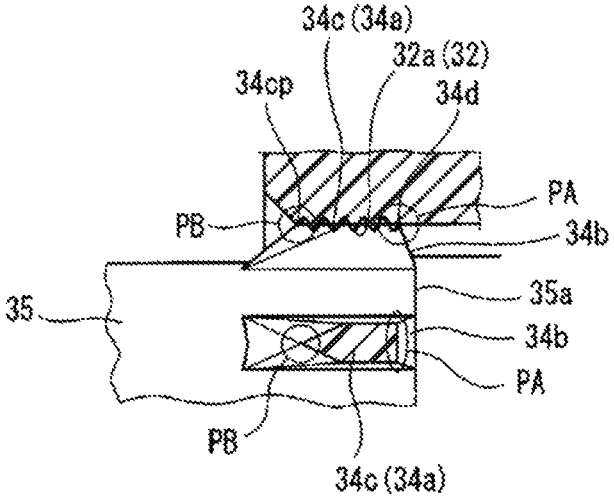
FIG. 8 is a main portion enlarged view of FIG. 7, explaining a place that will be broken when the waterproof pin is punched out.

When breaking is in progress, stress is controlled to concentrate on the rear end 34*d* of the coupling portion 34*a* between the pin retention portion 34 and the inner circumferential wall 32*a* of the through hole 32 so that shear breaking can start at the rear end position (the place shown by the circular portion PA in FIG. 8). This is because the coupling portion 34*a* between the pin retention portion 34 and the inner circumferential wall 32*a* of the through hole 32 is disposed more closely to the front side than the jig abutment surface 35*a* of the waterproof pin 35. In addition, it is also because the rear end face 34*b* of the pin retention portion 34 is made of a slope inclined frontward from the jig abutment surface 35*a* toward the coupling portion 34*a* with the inner circumferential wall 32*a* of the through hole 32. Thus, the start point of the shear breaking is defined at the rear end 34*d* of the coupling portion 34*a* so that burrs generated in the broken portion can be reduced.

In addition, the shear breaking occurring in the pre-shear breaking surface 34*c* of the coupling portion 34*a* between the pin retention portion 34 and the inner circumferential wall 32*a* of the through hole 32 is terminated at the front end 34*cp* of the pre-shear breaking surface 34*c* formed into a pointed end shape. Therefore, the finally broken place (which is the place shown by the circular portion PB in FIG. 8) can be made as small as possible. Thus, burrs are hardly generated.

Since burrs are hardly generated in the broken portion of each pin retention portion 34 in this manner, a terminal can be smoothly inserted into the through hole 32 from which the waterproof pin 35 has been punched out. In addition, the terminal to be inserted can be prevented from touching the burrs. Therefore, products having the burrs do not have to be dealt with as defective products. The embodiment can contribute to improvement in yield.

Next, a second embodiment of the invention will be described.

Figure 9:
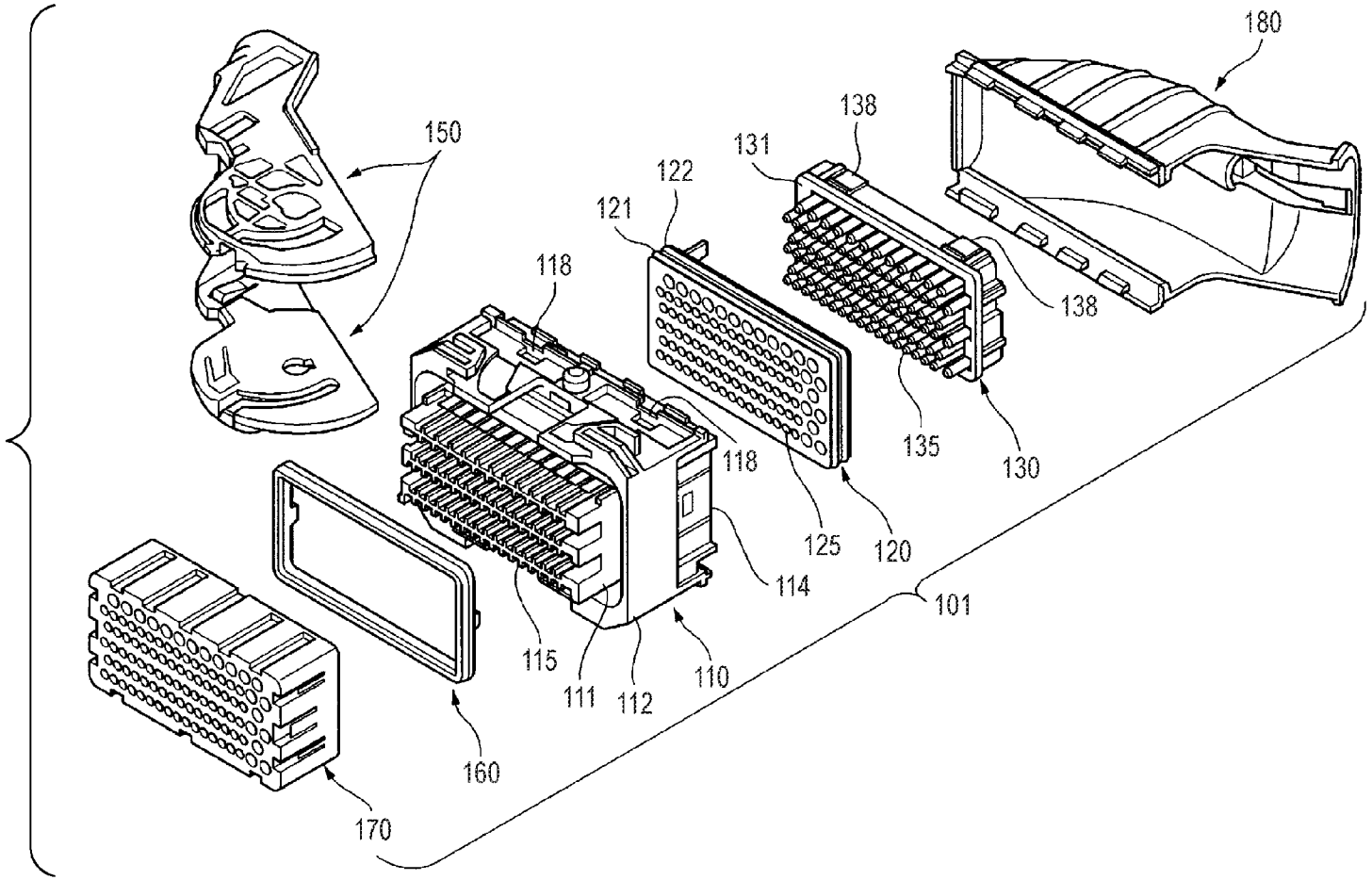
FIG. 9 is an exploded perspective view of a waterproof connector using a mat seal cover according to a second embodiment of the invention.

FIG. 9 is an exploded perspective view of a waterproof connector using a mat seal cover according to the embodiment.

As shown in FIG. 9, this waterproof connector 101 includes a connector housing 110 made of synthetic resin, a mat seal 120 made of rubber or soft resin, a mat seal cover 130 made of synthetic resin, a lever 150 made of synthetic resin, a packing 160, a front holder 170, and an electric wire cover 180. A plurality of terminals (not shown) are received in the connector housing 110 from the rear. The mat seal 120 is fitted to a rear portion of the connector housing 110. The mat seal cover 130 is fitted and fixed to the rear portion of the connector housing 110 so as to push the mat seal 120 from the rear side while preventing the mat seal 120 from coming off. The lever 150 is rotatably attached to the outside of the connector housing 110. The packing 160 is inserted into the inside of the connector housing 110 from the front. The front holder 170 is attached to a front portion of the connector housing 110. The electric wire cover 180 is attached to the rear side of the mat seal cover 130.

The connector housing 110 has an inner housing 111 disposed on the inner circumferential side, an outer housing 112 disposed on the outer circumferential side of the inner housing 111, and a cylindrical wall portion 114 disposed on the rear side of the inner housing 111 and the outer housing 112. The inner housing 111 has a plurality of terminal reception portions 115 for receiving terminals respectively. The mat seal 120 is fitted to the cylindrical wall portion 114. The outer housing 112 is a part that will be fitted to the outer circumference of a fitting cylindrical wall of a connector housing of a not-shown mating connector. The inner housing 111 is a part that will be fitted to the inner circumference of the fitting cylindrical wall of the connector housing of the mating connector. A rear end of the outer housing 112 is coupled with a rear end of the inner housing 111 and a front end of the cylindrical wall portion 114.

The mat seal 120 has a lip portion 122 in the outer circumference of a mat body 121. When the mat body 121 is fitted to the inner circumference of the cylindrical wall portion 114 in the rear portion of the connector housing 110, the lip portion 122 can seal up a gap between the mat body 121 and the cylindrical wall portion 114. Terminal insertion holes 125 are formed in the mat body 121 so as to penetrate the mat body 121 in positions corresponding to the terminal reception portions 115 of the connector housing 110 respectively. When terminals are inserted into the terminal reception portions 115 through the terminal insertion holes 125 respectively in the state where the mat seal 120 has been fitted to the inner circumference of the cylindrical wall portion 114 in the rear portion of the connector housing 110, the inner circumferences of the terminal insertion holes 125 are brought into tight contact with the outer circumferences of electric wires extending rearward from the terminals respectively. Thus, the mat seal 120 can seal up gaps between the electric wires and the connector housing 110 collectively.

Figure 10B:
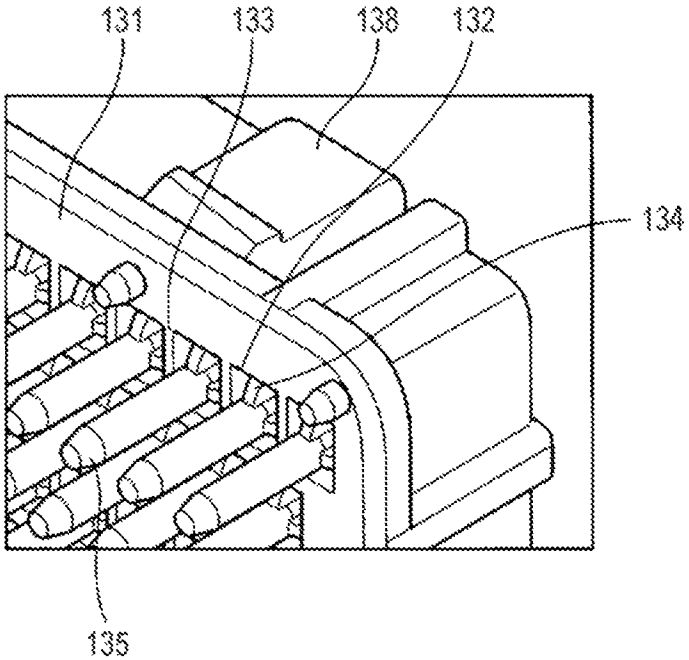
FIG. 10A includes a perspective view of the mat seal cover according to the second embodiment, and FIG. 10B includes a partially enlarged view of FIG. 10A.
Figure 10A:
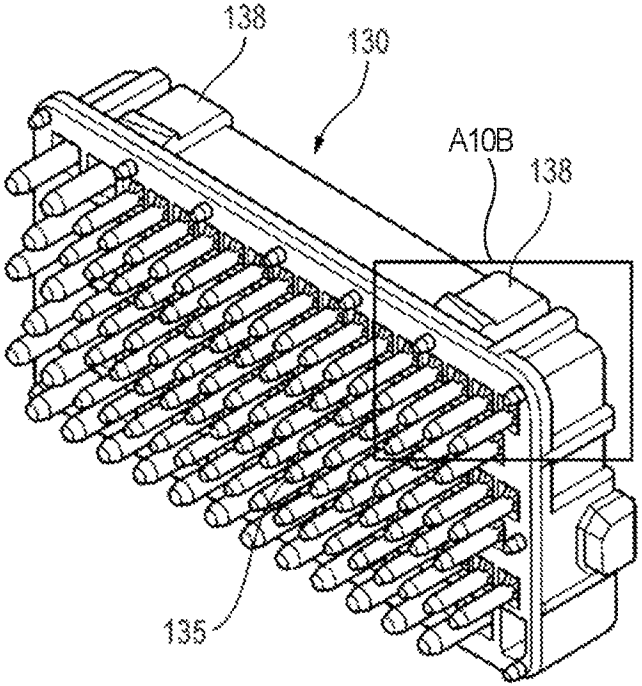
Figure 11A:
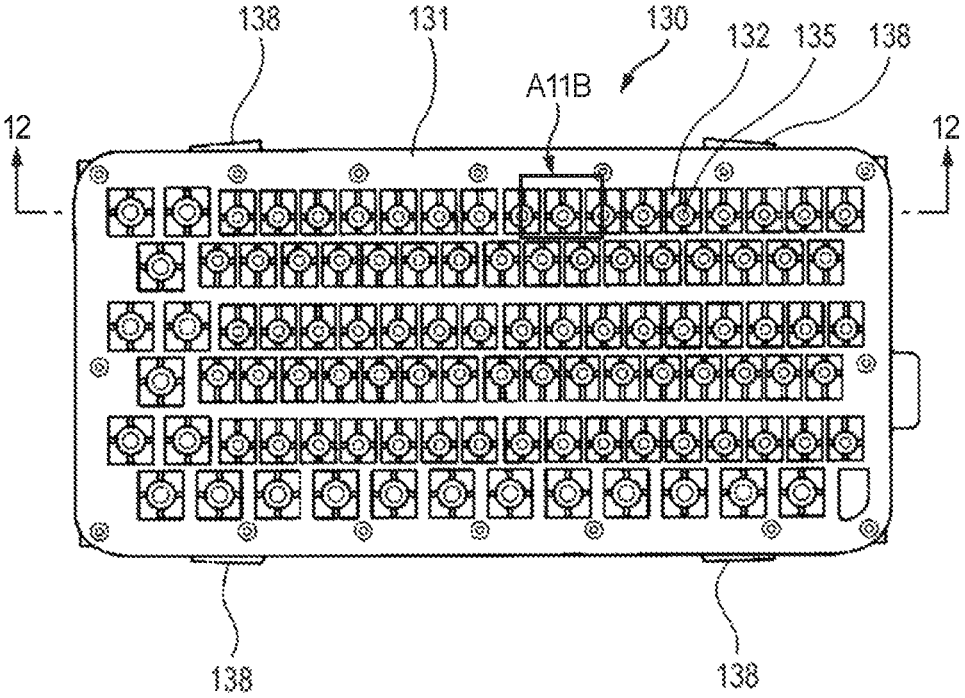
FIG. 11A is a front view of the mat seal cover.
Figure 11B:
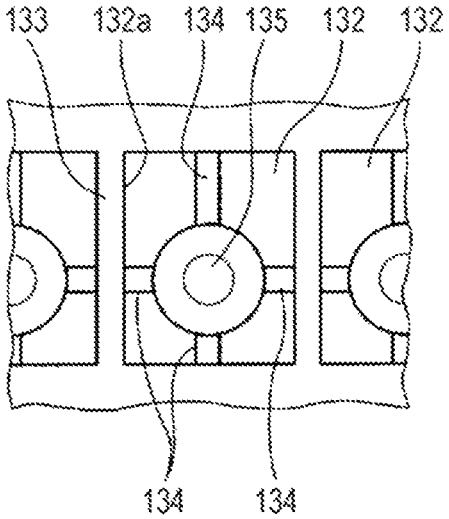
FIG. 11B is a schematic enlarged view of a portion A11B in FIG. 11A.
Figure 12A:
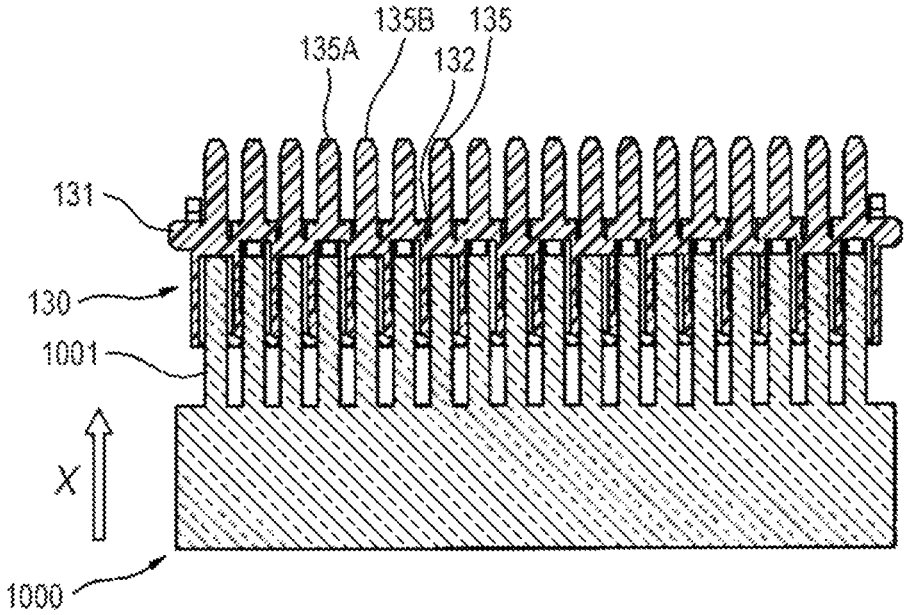
FIG. 12A is a sectional view taken from the arrow direction 12-12 in FIG. 11A.
Figure 12B:
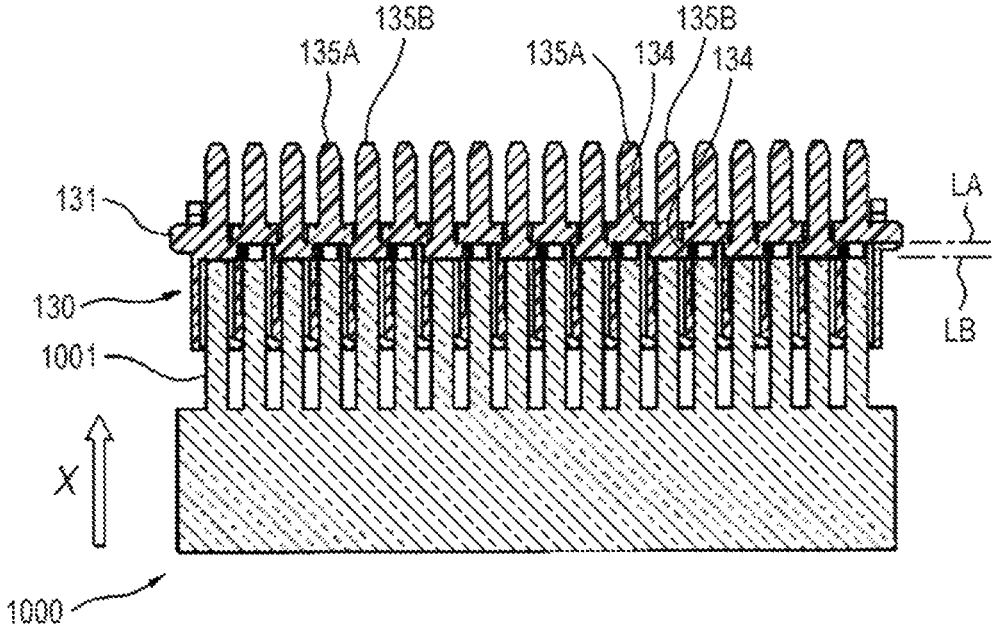
FIG. 12B is a similar view to FIG. 12A, depicted using thick lines to make it easy to understand that pin retention portions of waterproof pins adjacent to each other are displaced from each other in the front/rear direction alternately.
Figure 13A:
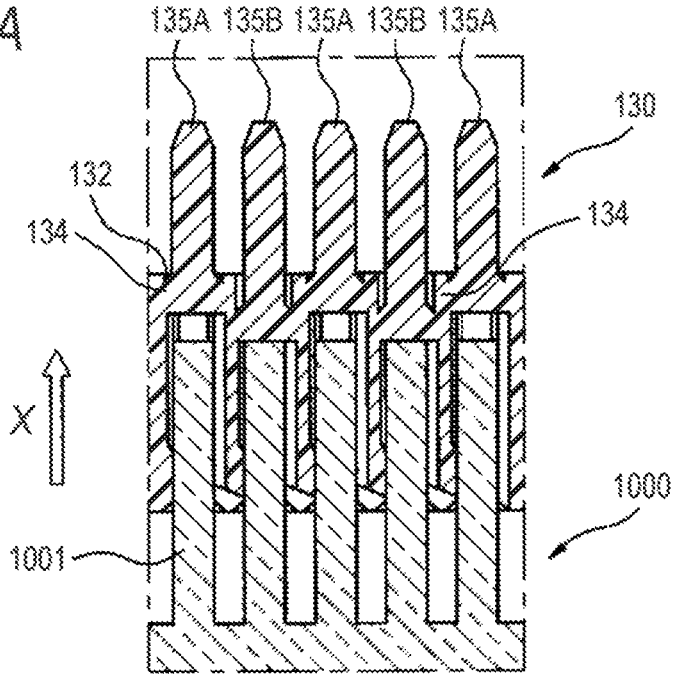
FIG. 13A is a partially enlarged view of FIG. 12A.
Figure 13B:
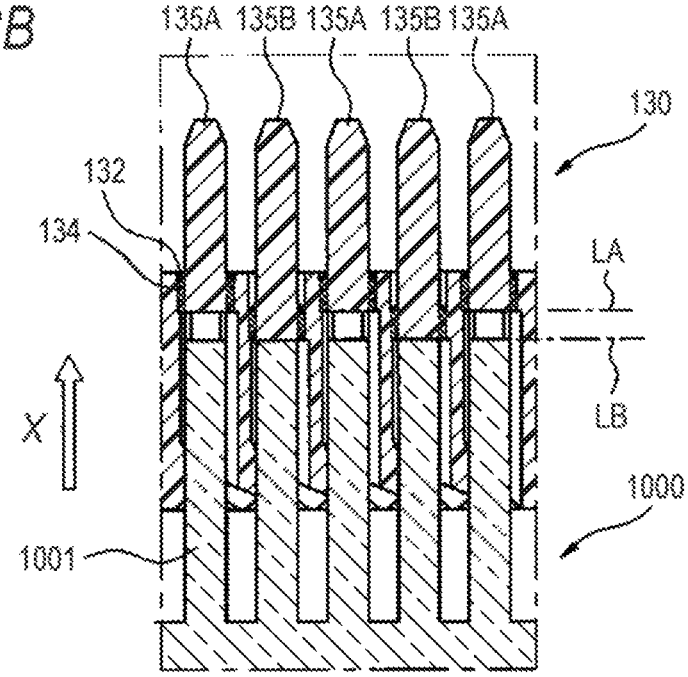
FIG. 13B is a similar view to FIG. 13A, plainly showing that pin retention portions of waterproof pins adjacent to each other are displaced from each other in the front/rear direction alternately.

FIG. 10A includes a perspective view of the mat seal cover, and FIG. 10B includes a partially enlarged view of FIG. 10A. FIG. 11A is a front view of the mat seal cover, and FIG. 11B is a schematic enlarged view of a portion A11B in FIG. 11A. FIG. 12A is a sectional view taken from the arrow direction 12-12 in FIG. 11A. FIG. 12B is a sectional view taken from the arrow direction 12-12 in FIG. 11A, depicted using thick lines to make it easy to understand that pin retention portions of waterproof pins adjacent to each other are displaced from each other in the front/rear direction alternately. FIG. 13A is a partially enlarged view of FIG. 12A, and FIG. 13B is a similar view to FIG. 13A, plainly showing that pin retention portions of waterproof pins adjacent to each other are displaced from each other in the front/rear direction alternately.

The mat seal cover 130 is disposed on the rear side of the mat seal 120 as shown in FIG. 9. When lock portions 138 of the mat seal cover 130 are engaged with lock portions 118 of the connector housing 110, the mat seal cover 130 can prevent the mat seal 120 from coming off and perform a function for giving a pressing force to the mat seal 120 to thereby secure satisfactory sealing performance.

As shown in FIG. 10A to FIG. 13, through holes 132 to which terminals can be inserted and from which electric wires can be extracted toward the rear are provided in the cover body 131 of the mat seal cover 130 made of a synthetic resin molded piece. The through holes 132 are located in positions corresponding to the terminal insertion holes 125 of the mat seal 120 respectively. Waterproof pins 135 are provided in all the through holes 132 respectively and integrally thereto through pin retention portions 134. Each through hole 32 includes a pair of openings, one at each end face of the mat seal cover 130.

Each waterproof pin 135 serves for closing a corresponding one of terminal insertion holes 125 of the mat seal 120 corresponding to, of the whole terminal reception portions 115 of the connector housing 110, terminal reception portions 115 located in nonuse positions. Each waterproof pin 135 is retained at two or more circumferential places of the waterproof pin 135 by breakable pin retention portions 134 built between the waterproof pin 135 and an inner circumferential wall 132*a* of a through hole 132. In this embodiment, the pin retention portions 134 are, for example, coupled with opposite side faces (the inner circumferential wall of the through hole 132) of partition walls 133 between adjacent through holes 132, as shown in FIG. 11B and FIG. 13B.

The pin retention portions 134 coupled with the opposite side faces (the inner circumferential wall of the through hole 132) of the partition walls 133 between adjacent through holes 132 are arranged on the opposite sides of the waterproof pin 135 and in the same position in view from the front of the through holes 132. Accordingly, the pin retention portions 134 are located on a single line drawn substantially in parallel with the arrangement direction of the through holes 132.

The pin retention portions 134 of adjacent waterproof pins 135 (135A and 135B) are disposed alternately in positions shifted from each other in a pushing direction (front/rear direction) X of a punching jig 1000, as shown in FIG. 12A, FIG. 12B, FIG. 13A and FIG. 13B. That is, the pin retention portions 134 of waterproof pins 135A of a first group arranged in every other through holes 132 are disposed to be arranged on a line LA set in a front position in the pushing direction X of the punching jig 1000. On the other hand, the pin retention portions 134 of waterproof pins 135B of a second group arranged adjacently to the waterproof pins 13A of the first group are disposed to be arranged in rear positions in the pushing direction X of the punching jig 1000, that is, on a line LB displaced on the rear side from the line LA by a distance corresponding to the length of each pin retention portion 134.

In addition, when each waterproof pin 135 cannot be retained satisfactorily only by the pin retention portions 134, another retention pin 134 or other retention pins 134 are disposed at one place or two opposite places perpendicular to the arrangement direction of adjacent through holes 132 in accordance with necessary, as shown in FIG. 11B.

When the mat seal cover 130 is used, the waterproof pins 135 in the through holes 132 corresponding to the terminal reception portions 115 in use positions in the connector housing 110 are punched out and removed in advance by the punching jig 1000. That is, of the whole terminal reception portions 115 of the connector housing 110, some terminal reception portions 115 may be located in nonuse positions. In this case, as shown in FIG. 12A to FIG. 13B, punching pins 1001 of the punching jig 1000 are pushed in from the rear to thereby break the pin retention portions 134. Thus, extruding the waterproof pins 135 corresponding to the terminal reception portions 115 located in nonuse positions, the waterproof pins 135 corresponding to the terminal reception portions 115 located in use positions are punched out and removed.

Incidentally, although the punching pins 1001 corresponding to the whole waterproof pins 135 are provided in the punching jig 1000 shown in FIG. 12A to FIG. 13B, a punching jig 1000 provided with punching pins 1001 only in required positions is used in fact.

Figure 14:
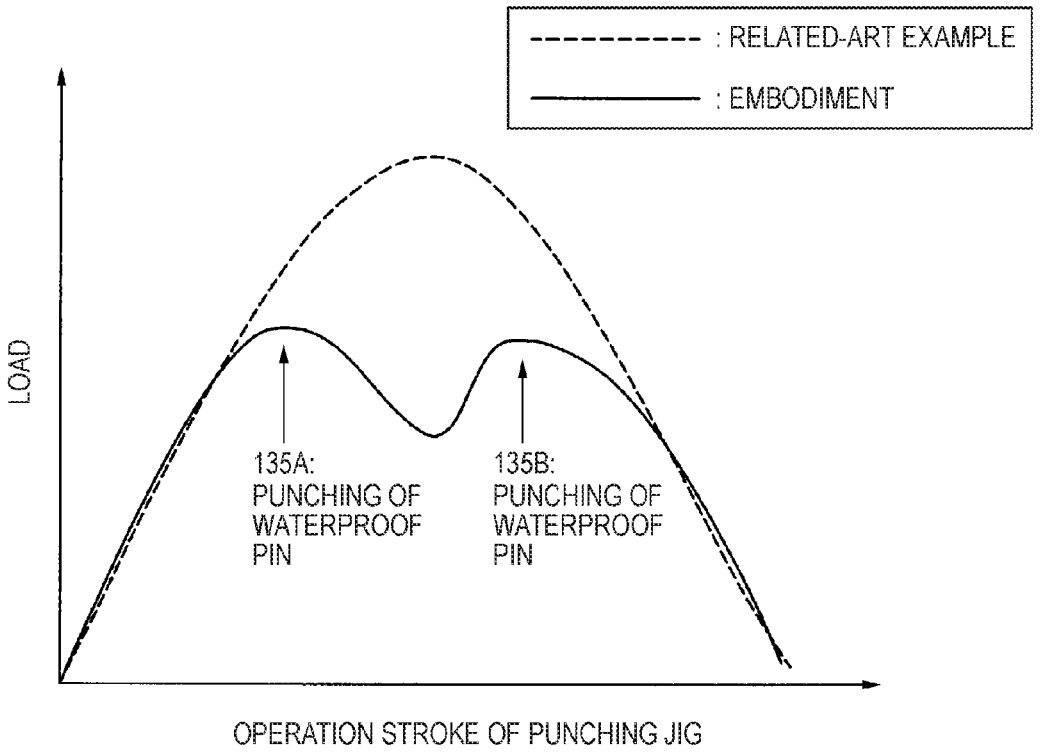
FIG. 14 is a characteristic graph showing the relationship between the magnitude of a load (breaking load) acting on a partition wall between through holes and an operation stroke of a punching jig in a case (related-art example) where pin retention portions of waterproof pins adjacent to each other are disposed in the same position in the punching direction and in a case (embodiment of the invention) where pin retention portions of waterproof pins adjacent to each other are disposed in positions displaced from each other in the punching direction.

FIG. 14 is a characteristic graph showing the relationship between the magnitude of a load (breaking load of pin retention portions 134) acting on a partition wall between through holes and an operation stroke of a punching jig in a case (related-art example) where pin retention portions of waterproof pins adjacent to each other are disposed in the same position in the punching direction and in a case (embodiment of the invention) where pin retention portions of waterproof pins adjacent to each other are disposed in positions displaced from each other in the punching direction.

When the waterproof pins 135 are punched out as described above, there may be a case that adjacent waterproof pins 135 must be punched out.

In this case, the pin retention portions 134 of the adjacent waterproof pins 135 are disposed in the same position in the front/rear direction (the pushing direction X of the punching jig 1000) in the related-art mat seal cover. Therefore, the breaking load acting on the pin retention portions 134 concentrates on the same place of a partition wall 133 between through holes 132 and at the same timing. As a result, a peak load (load) during the punching operation increases as shown by the broken line in FIG. 14.

However, in the mat seal cover 130 according to the embodiment, the pin retention portions 134 of the adjacent waterproof pins 135A and 135B are disposed in positions displaced from each other in the front/rear direction (the pushing direction X of the punching jig 1000). Therefore, the breaking loads acting on the pin retention portions 134 when the adjacent waterproof pins 135A and 135B are punched out act on the partition wall 133 between the through holes 132 at positions displaced from each other and at timings shifted from each other.

That is, as shown by the solid line in FIG. 14, the pin retention portions 134 of the waterproof pins 135B belonging to the second group are broken in an early stage of the stroke of the punching jig 1000. At the next timing in which the stroke has increased, the pin retention portions 134 of the waterproof pins 135A belonging to the first group are broken. Accordingly, the peak of the load can be distributed so that a peak load (load) for punching can be reduced. Thus, the partition wall 133 between the adjacent through holes 132 can be prevented from being damaged.

Next, a third embodiment of the invention will be described.

Figure 15:
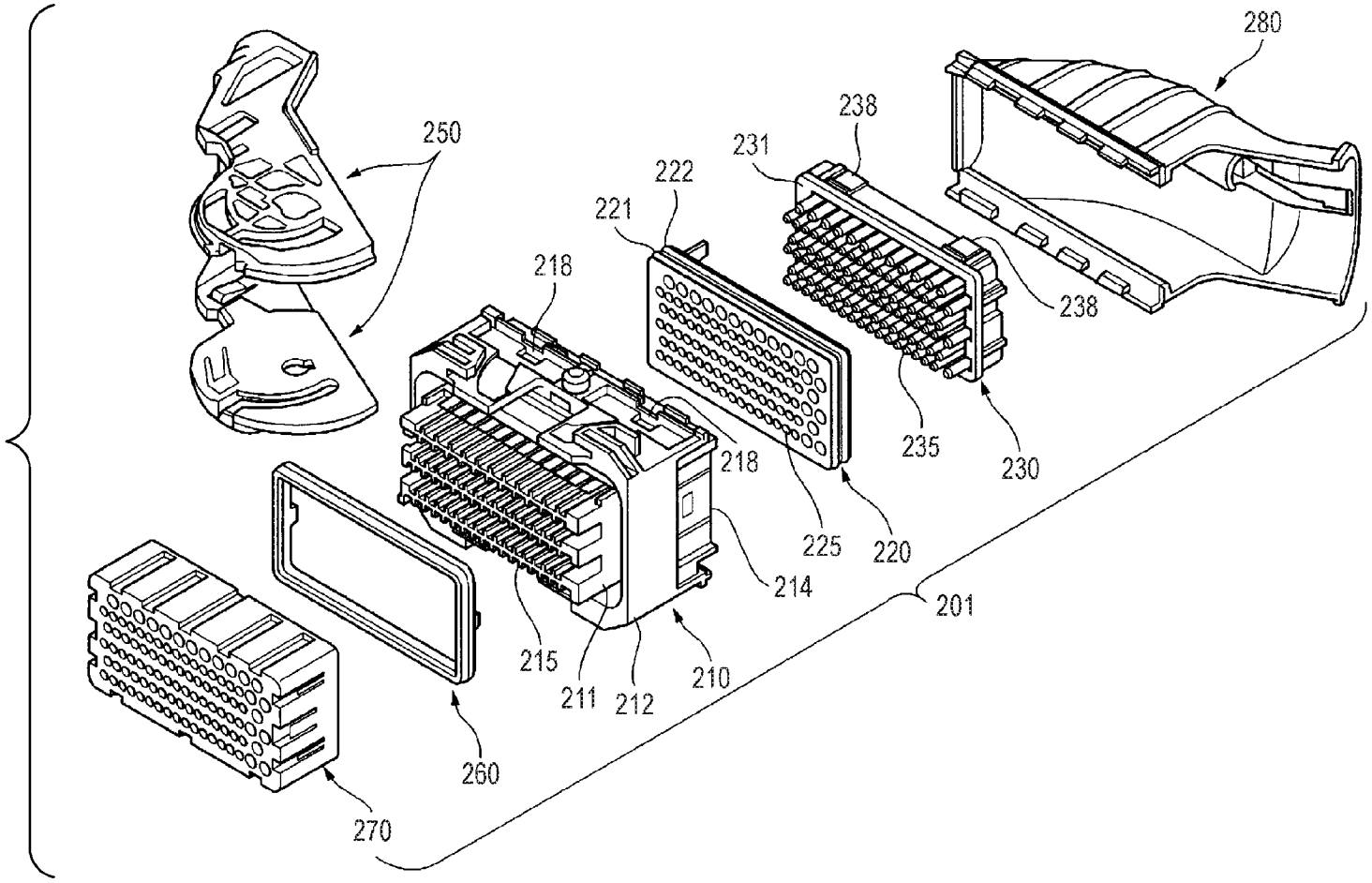
FIG. 15 is an exploded perspective view of a waterproof connector of a mat seal cover according to a third embodiment of the invention.

FIG. 15 is an exploded perspective view of a waterproof connector using a mat seal cover according to the embodiment.

As shown in FIG. 15, this waterproof connector 201 includes a connector housing 210 made of synthetic resin, a mat seal 220 made of rubber or soft resin, a mat seal cover 230 made of synthetic resin, a lever 250 made of synthetic resin, a packing 260, a front holder 270, and an electric wire cover 280. A plurality of terminals (not shown) are received in the connector housing 210 from the rear. The mat seal 220 is fitted to a rear portion of the connector housing 210. The mat seal cover 230 is fitted and fixed to the rear portion of the connector housing 210 so as to push the mat seal 220 from the rear side while preventing the mat seal 220 from coming off. The lever 250 is rotatably attached to the outside of the connector housing 210. The packing 260 is inserted into the inside of the connector housing 210 from the front. The front holder 270 is attached to a front portion of the connector housing 210. The electric wire cover 280 is attached to the rear side of the mat seal cover 230.

The connector housing 210 has an inner housing 211 disposed on the inner circumferential side, an outer housing 212 disposed on the outer circumferential side of the inner housing 211, and a cylindrical wall portion 214 disposed on the rear side of the inner housing 211 and the outer housing 212. The inner housing 211 has a plurality of terminal reception portions 215 for receiving terminals respectively. The mat seal 220 is fitted to the cylindrical wall portion 214. The outer housing 212 is a part that will be fitted to the outer circumference of a fitting cylindrical wall of a connector housing of a not-shown mating connector. The inner housing 211 is a part that will be fitted to the inner circumference of the fitting cylindrical wall of the connector housing of the mating connector. A rear end of the outer housing 212 is coupled with a rear end of the inner housing 211 and a front end of the cylindrical wall portion 214.

The mat seal 220 has a lip portion 222 in the outer circumference of a mat body 221. When the mat body 221 is fitted to the inner circumference of the cylindrical wall portion 214 in the rear portion of the connector housing 210, the lip portion 222 can seal up a gap between the mat body 221 and the cylindrical wall portion 214. Terminal insertion holes 225 are formed in the mat body 221 so as to penetrate the mat body 221 in positions corresponding to the terminal reception portions 215 of the connector housing 210 respectively. When terminals are inserted into the terminal reception portions 215 through the terminal insertion holes 225 respectively in the state where the mat seal 220 has been fitted to the inner circumference of the cylindrical wall portion 214 in the rear portion of the connector housing 210, the inner circumferences of the terminal insertion holes 225 are brought into tight contact with the outer circumferences of electric wires extending rearward from the terminals respectively. Thus, the mat seal 220 can seal up gaps between the electric wires and the connector housing 210 collectively.

Figure 16B:
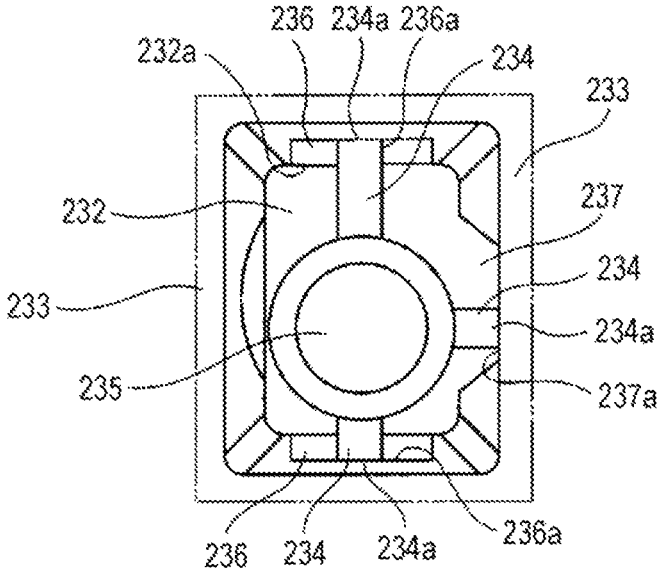
FIG. 16A includes a front view of the mat seal cover and FIG. 16B includes a partially enlarged view of FIG. 16A.
Figure 16A:
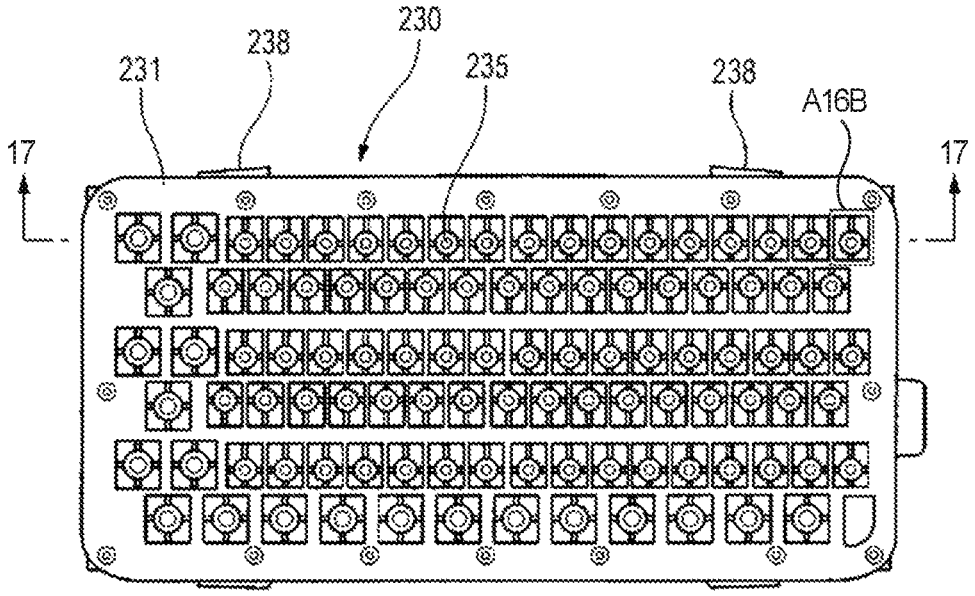
Figure 17:
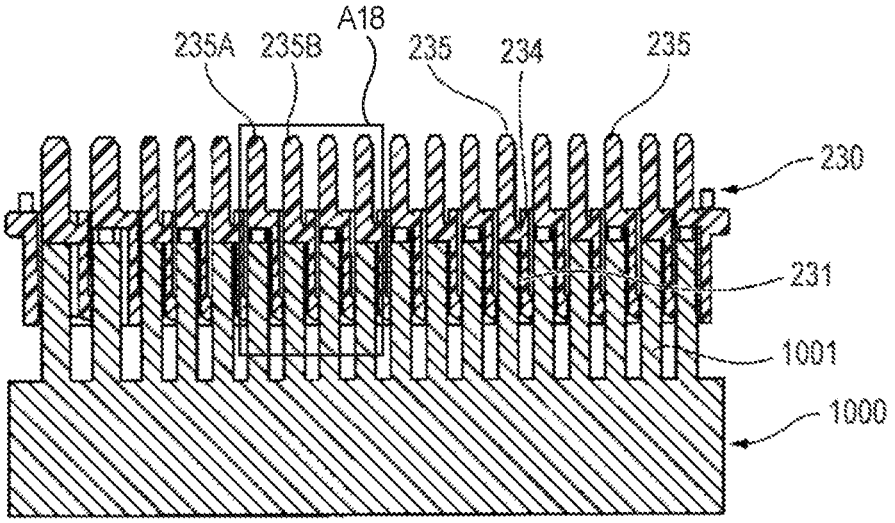
FIG. 17 is a sectional view taken from the arrow direction 17-17 in FIG. 16A.
Figure 18:
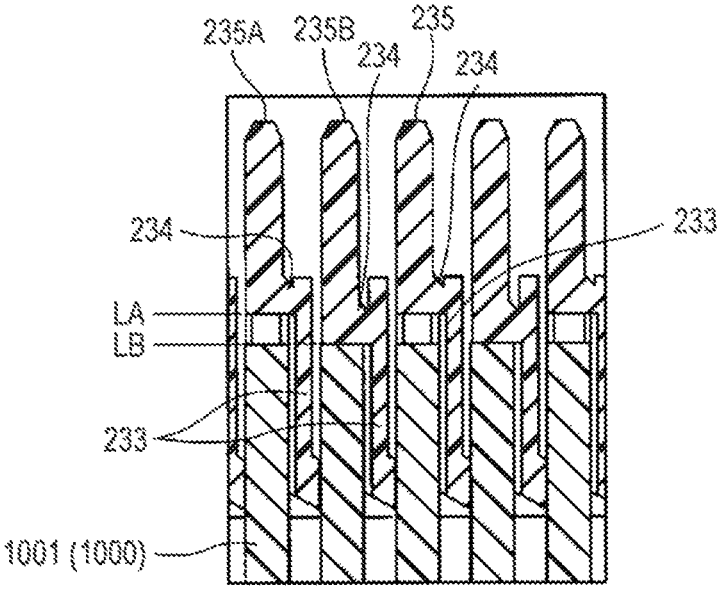
FIG. 18 is a partially enlarged view of FIG. 17.

FIG. 16A includes a front view of the mat seal cover, and FIG. 16B includes a partially enlarged view of FIG. 16A. FIG. 17 is a sectional view taken from the arrow direction 17-17 in FIG. 16A. FIG. 18 is a partially enlarged view of FIG. 17.

The mat seal cover 230 is disposed on the rear side of the mat seal 220 as shown in FIG. 15. When lock portions 238 of the mat seal cover 230 are engaged with lock portions 218 of the connector housing 210, the mat seal cover 230 can prevent the mat seal 220 from coming off and perform a function for giving a pressing force to the mat seal 220 to thereby secure satisfactory sealing performance.

As shown in FIG. 16A to FIG. 18, through holes 232 to which terminals can be inserted and from which electric wires can be extracted toward the rear are provided in the cover body 231 of the mat seal cover 230 made of a synthetic resin molded piece. The through holes 232 are located in positions corresponding to the terminal insertion holes 225 of the mat seal 220 respectively. Waterproof pins 235 are provided in all the through holes 232 respectively and integrally thereto through pin retention portions 234. Each through hole 32 includes a pair of openings, one at each end face of the mat seal cover 30.

Each waterproof pin 235 serves for closing a corresponding one of terminal insertion holes 225 of the mat seal 220 corresponding to, of the whole terminal reception portions 215 of the connector housing 210, terminal reception portions 215 located in nonuse positions. Each waterproof pin 235 is retained at two or more circumferential places of the waterproof pin 235 by breakable pin retention portions 234 built between the waterproof pin 235 and an inner circumferential wall 232*a* of a through hole 232.

In this embodiment, the pin retention portions 234 are, for example, disposed in upper and lower positions of the waterproof pin 235 in a direction perpendicular to the direction in which the through holes 232 are arranged laterally. A coupling portion 234*a* between each pin retention portion 234 and the inner circumferential wall 232*a* of the through hole 232 is disposed in a bottom face 236*a* of a concave portion 236 provided in the inner circumferential wall 232*a* of the through hole 232.

In addition, a concave portion 237 like an arc is also formed in one side face (the inner circumferential wall 232*a* of the through hole 232) of the partition wall 233 between adjacent through holes 232. As shown in FIGS. 16A and B, in addition to the pin retention portions 234 disposed in the upper and lower of the waterproof pin 235 respectively, another pin retention portion 234 for retaining the waterproof pin 235 is disposed in one side of the waterproof pin 235 in the state where the coupling portion 234*a* is disposed in a bottom face 237*a* of the concave portion 237 like an arc.

When the mat seal cover 230 is used, the waterproof pins 235 in the through holes 232 corresponding to the terminal reception portions 215 in use positions in the connector housing 210 are punched out and removed in advance by the punching jig 1000. That is, of the whole terminal reception portions 215 of the connector housing 210, some terminal reception portions 215 may be located in nonuse positions. In this case, as shown in FIG. 17 and FIG. 18, punching pins 1001 of the punching jig 1000 are pushed in from the rear to thereby break the pin retention portions 234. Thus, extruding the waterproof pins 235 corresponding to the terminal reception portions 215 located in nonuse positions, the waterproof pins 235 corresponding to the terminal reception portions 215 located in use positions are punched out and removed.

Incidentally, although the punching pins 1001 corresponding to the whole waterproof pins 235 are provided in the punching jig 1000 shown in FIG. 17 and FIG. 18, a punching jig 1000 provided with punching pins 1001 only in required positions is used in fact.

Figure 19B:
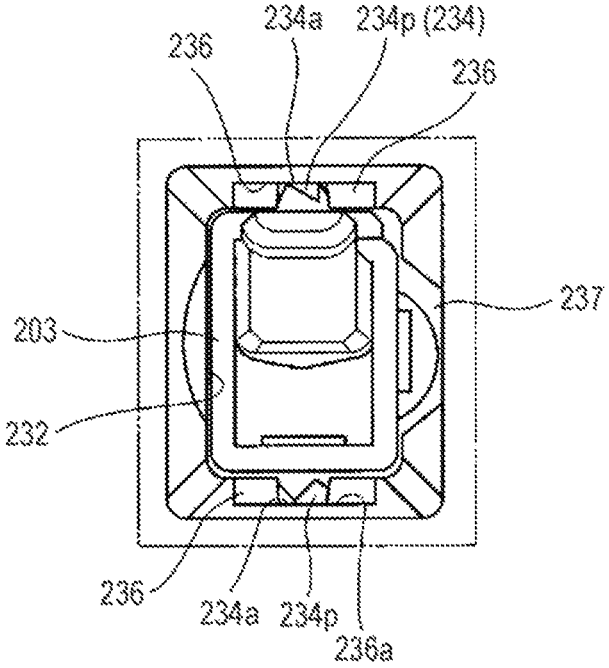
FIG. 19A includes a front view of the mat seal cover and FIG. 19B includes a partially enlarged view of FIG. 19A, showing that a terminal can be inserted into a through hole without being affected by burrs appearing in broken portions of pin retention portions.
Figure 19A:
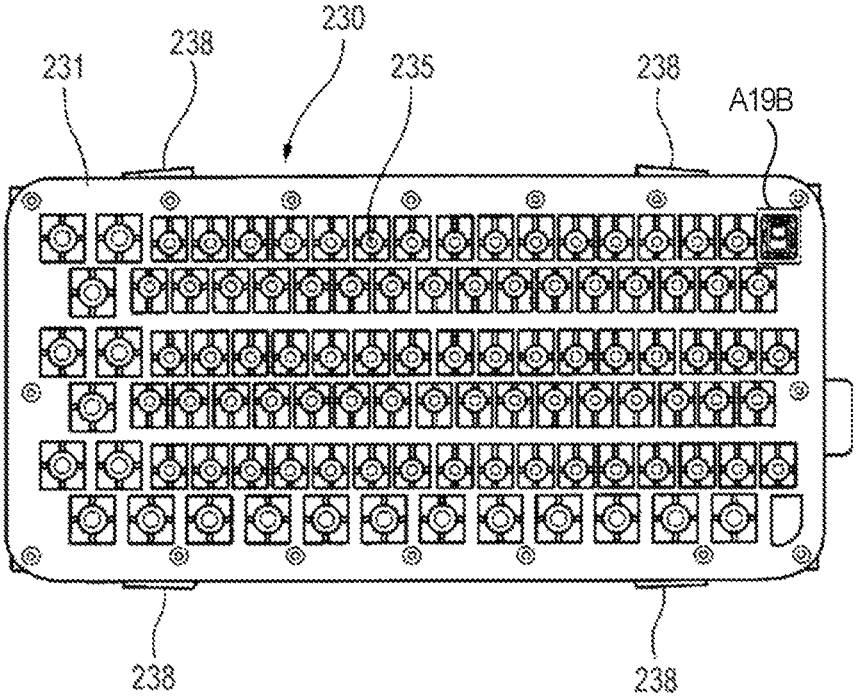
Figure 20:
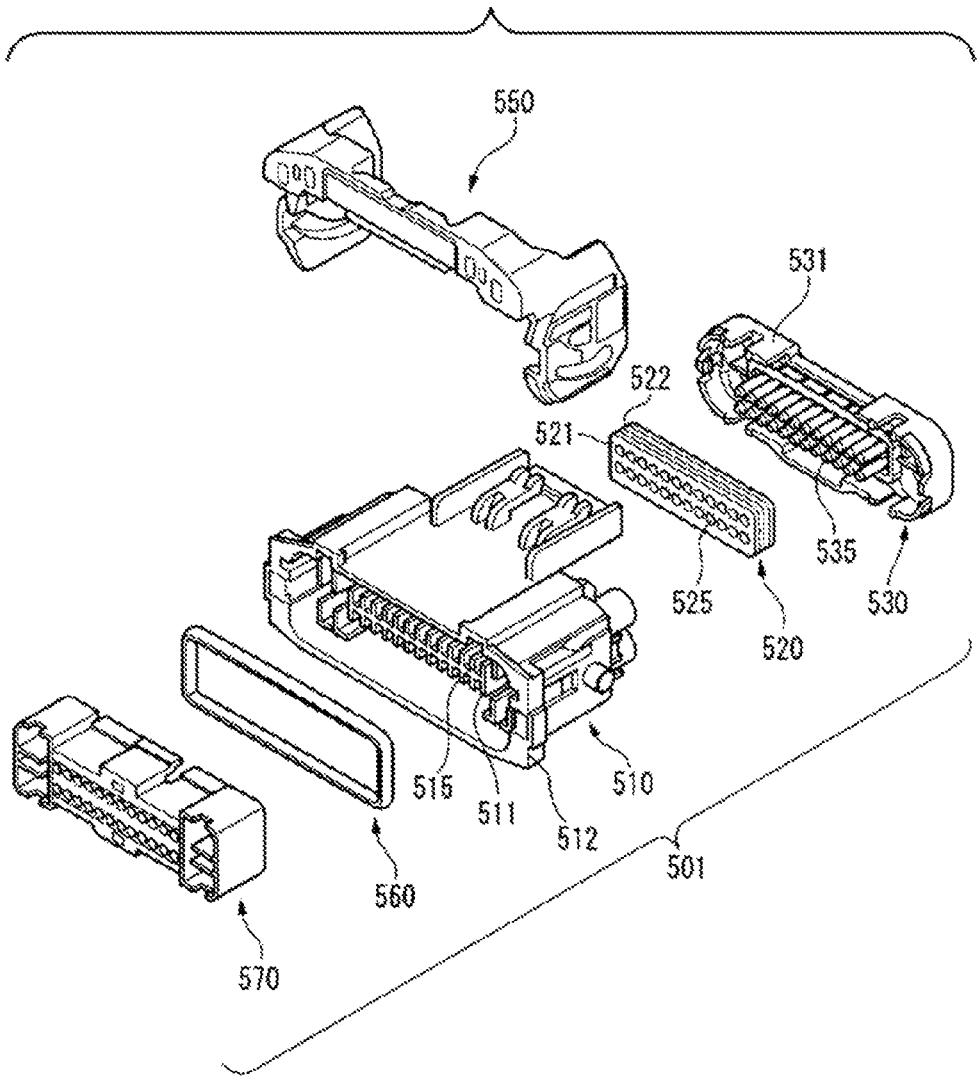
FIG. 20 RELATED ART
FIG. 20 is an exploded perspective view of a related-art waterproof connector.
Figure 21A:
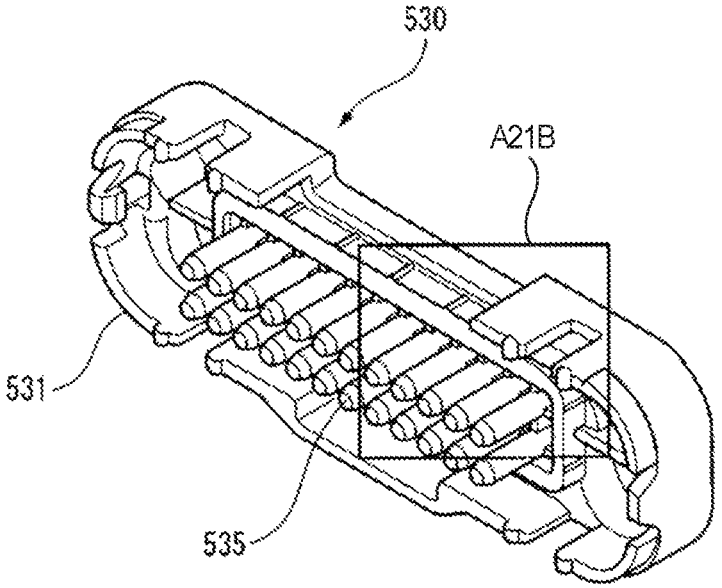
FIG. 21A RELATED ART
FIG. 21A includes a perspective view showing the configuration of a mat seal cover in the related-art waterproof connector, and FIG. 21B includes a partially enlarged view of FIG. 21A.
Figure 21B:
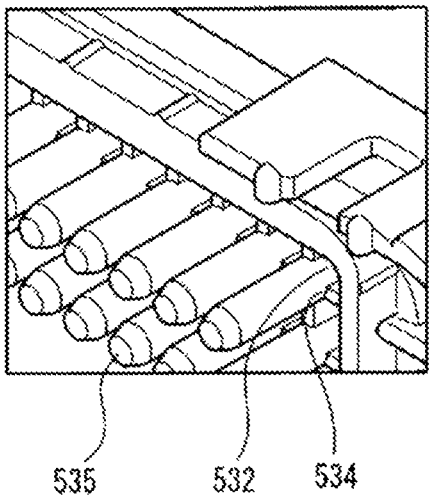
Figure 22:
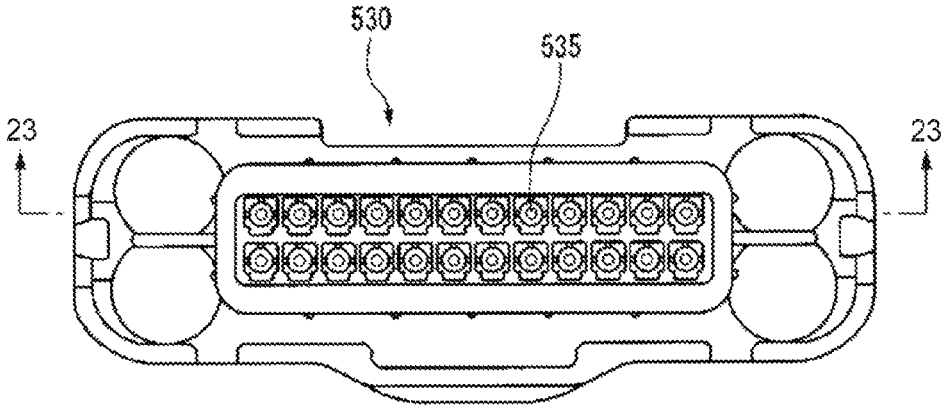
FIG. 22 RELATED ART
FIG. 22 is a front view of the mat seal cover in the related-art waterproof connector.
Figure 23:
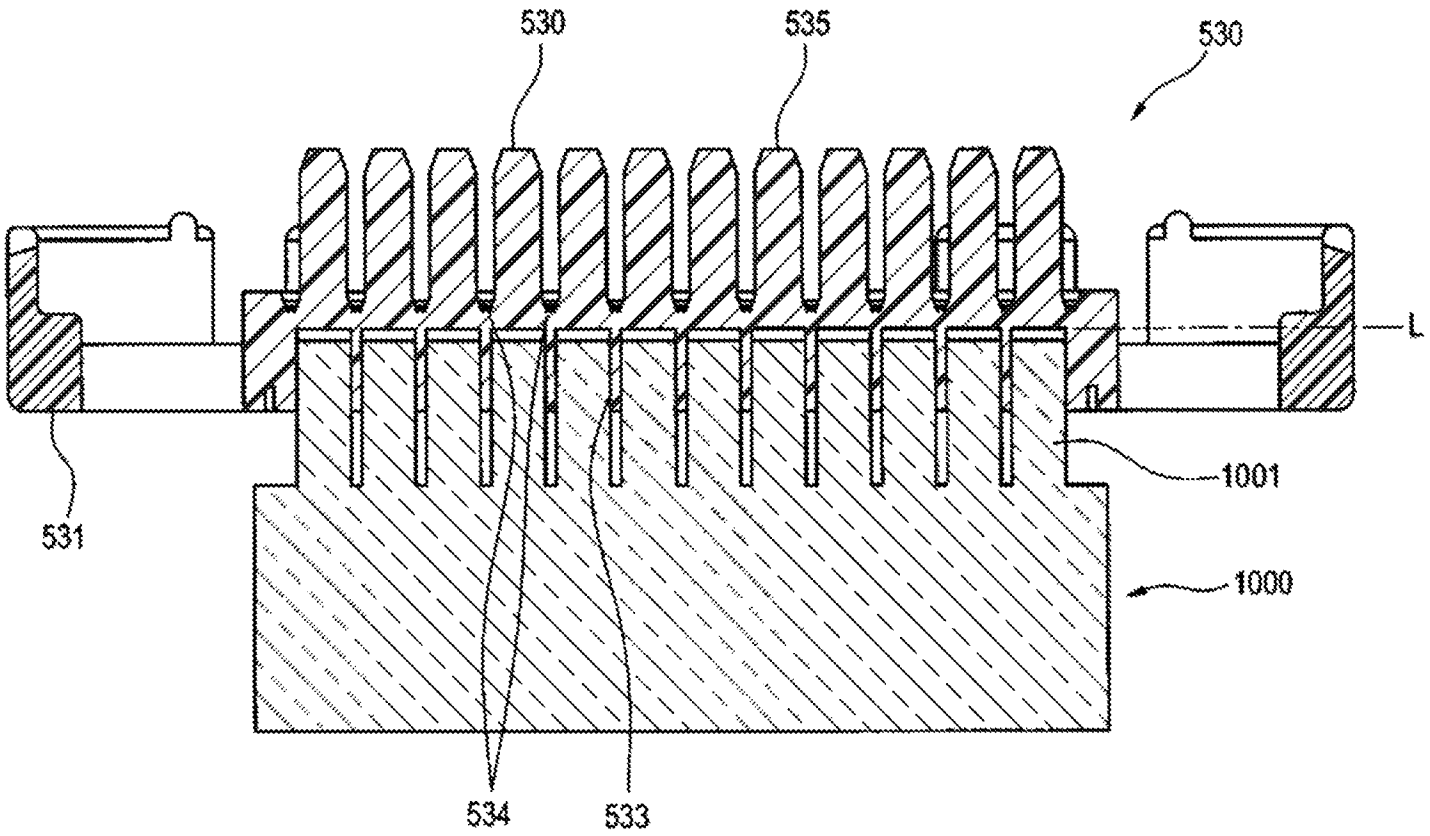
FIG. 23 RELATED ART
FIG. 23 is a sectional view taken from the arrow direction 23-23 in FIG. 22, depicted in combination with a punching jig.
Figure 24A:
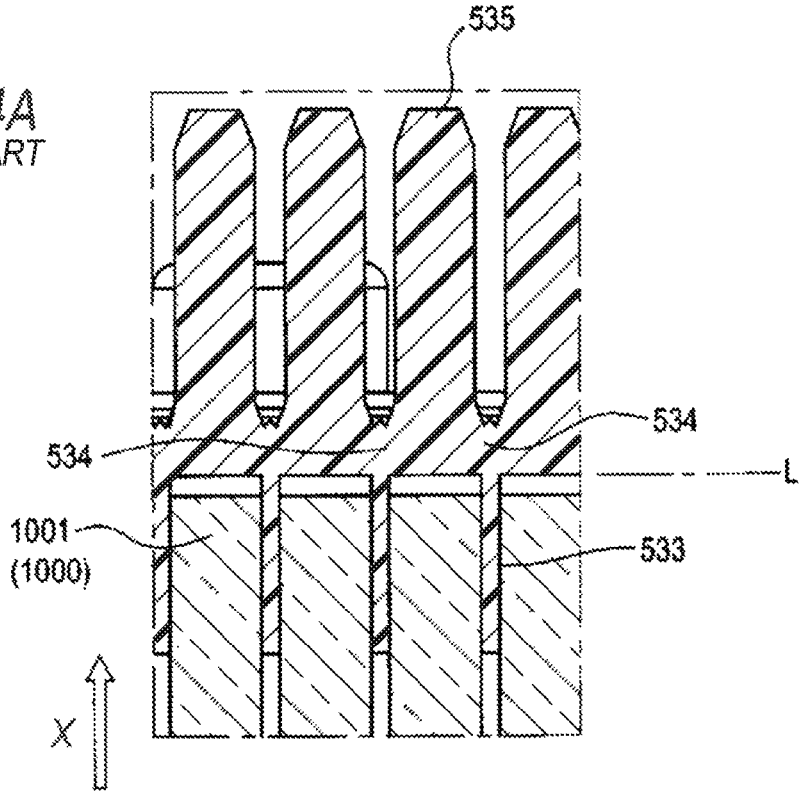
FIG. 24A RELATED ART
FIG. 24A is a partially enlarged view of FIG. 23.
Figure 24B:
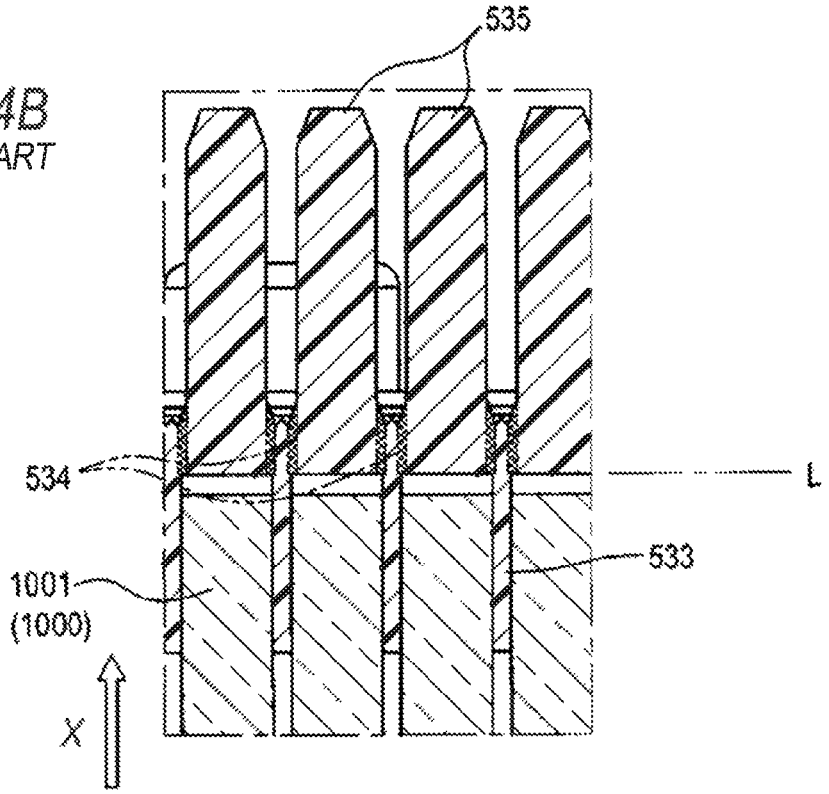
FIG. 24B RELATED ART
FIG. 24B is a similar view to FIG. 24A, plainly showing pin retention portions and partition walls among through holes.
Figure 25:
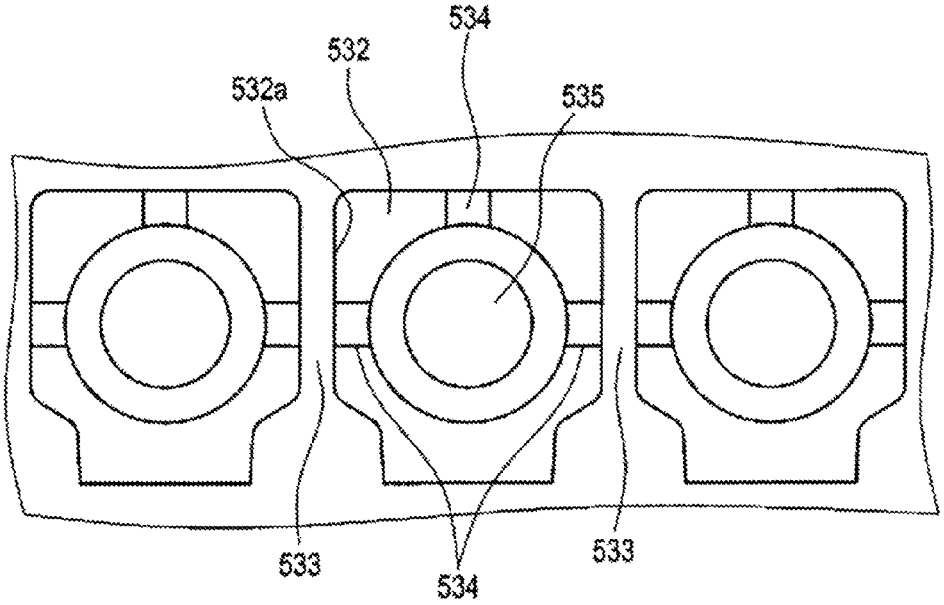
FIG. 25 RELATED ART
FIG. 25 is a front view plainly showing the relationship among waterproof pins, pin retention portions and through holes.
Figure 26A:
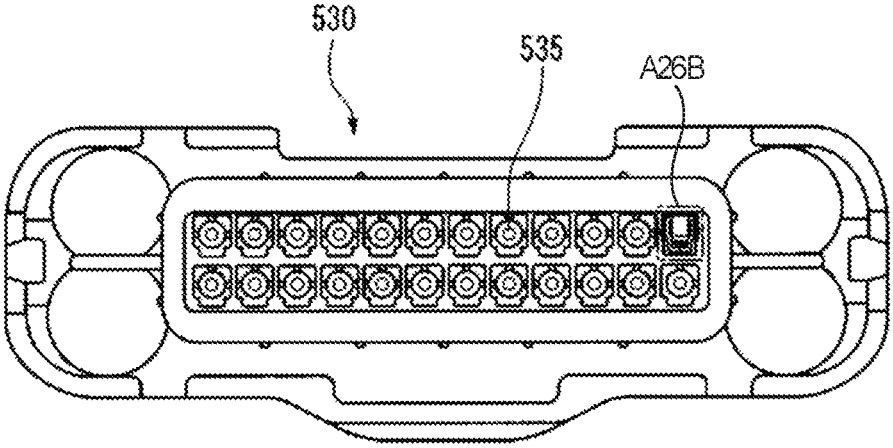
FIG. 26A RELATED ART
FIG. 26 includes a front view of the mat seal cover and a partially enlarged view of the same, showing that a terminal is affected by burrs appearing in broken portions of pin retention portions so that the terminal cannot be inserted into a through hole smoothly.
Figure 26B:
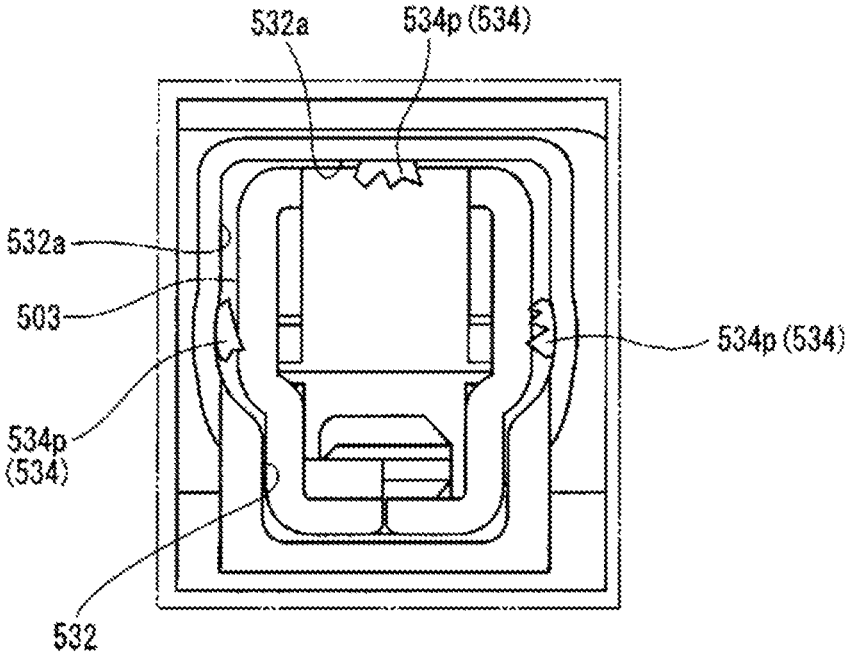
FIG. 26B RELATED ART

When the pin retention portions 234 are broken and the waterproof pins 235 are punched out as described above, some burrs 234*p* may survive in broken portions (the coupling portions 234*a* with the inner circumferential walls 232*a* of the through holes 232 are regarded as parts easy to be broken) of the pin retention portions 234 as shown in FIGS. 19A and 19B. However, the surviving burrs 234*p* cause no interference with insertion of terminals 203 into the through holes 232 of the mat seal cover 230 as long as the burrs 234*p* are put within depth of each concave portion 236 (237).

That is, there are no obstructive foreign substances (burrs 234*p*) in the spaces to which the terminals 203 should be inserted. Thus, the terminals 203 can be inserted smoothly. In addition, there is no fear that the terminals 203 to be inserted may touch the burrs 234*p*. Accordingly, there is no fear that fragments of the burrs 234*p* may be caught by the terminals 203, causing a contact failure. Products having some burrs 234*p* do not have to be dealt with as defective products. Thus, the embodiment can contribute to improvement in yield.

Incidentally, the invention is not limited to the aforementioned embodiments, but suitable deformations, improvements and so on may be made thereon. In addition, materials, shapes, dimensions, numbers, arrangement places, etc. of constituent elements in the aforementioned embodiments are not limited but may be selected desirably if the invention can be attained. For example, any feature of the second embodiment and the third embodiment can be combined with the feature of the first embodiment.

Here, the aforementioned features of the embodiments of the mat seal cover according to the invention will be summarized and listed in the following paragraphs [1] to [6] respectively.

[1] A mat seal cover (30) of a waterproof connector, including:

a plurality of through holes (32) that correspond to terminal insertion holes (25) of a mat seal (20) corresponding to terminal reception portions (15) of a connector housing (10);

waterproof pins (35) provided inside the through holes (32) and configured to close the terminal insertion holes (25); and breakable pin retention portions (34) provided between the waterproof pins (35) and inner circumferential walls (32*a*) of the through holes (32) so as to bridge gaps therebetween, wherein the waterproof pins (35) are retained in the through holes (32) by the pin retention portions (34) and the waterproof pins (35) corresponding to the terminal reception portions (15) located in use positions are configured to be punched and removed when the pin retention portions (34) are broken by a punching jig (1000) pushed in from the rear; and wherein coupling portions (34*a*) between the pin retention portions (34) and the inner circumferential walls (32*a*) of the through holes (32) are disposed more closely to the front side in the pushing direction of the punching jig (1000) than abutment surfaces (35*a*) at rear ends of the waterproof pins (35) against which the punching jig (1000) abuts, and rear end faces (34*b*) of the pin retention portions (34) are inclined faces extending from the abutment surfaces (35*a*) toward the coupling portions (34*a*) and inclined to the front in the pushing direction of the punching jig (1000).

[2] The mat seal cover (30) of a waterproof connector according to the aforementioned paragraph [1], wherein, of a pre-pre-shear breaking surface (34*c*) of each of the coupling portions (34*a*) between the pin retention portions (34) and the inner circumferential walls (32*a*) of the through holes (32), a front end in the pushing direction of the punching jig (1000) has a pointed end shape pointed to the front in the pushing direction.

[3] The mat seal cover (130) of a waterproof connector according to the aforementioned paragraph [1], wherein, of the pin retention (135), the pin retention portions (134) retaining adjacent ones of the waterproof pins (135) are disposed to be displaced from each other in the pushing direction (X) of the punching jig (1000).

[4] The mat seal cover (230) of a waterproof connector according to the aforementioned paragraph [1], wherein the coupling portions (234*a*) between the pin retention portions (234) and the inner circumferential walls (232*a*) of the through holes (232) are disposed in bottom faces (236*a*) of concave portions (236) provided in the inner circumferential walls (232*a*) of the through holes (232).

[5] A mat seal cover (130) of a waterproof connector, including:

a plurality of through holes (132) that correspond to terminal insertion holes (125) of a mat seal (120) corresponding to terminal reception portions (115) of a connector housing (110);

waterproof pins (135) that are provided inside the through holes (132) to close the terminal insertion holes (125); and breakable pin retention portions (134) that are built between the waterproof pins (135) and inner circumferential walls (132*a*) of the through holes (132); wherein:

the waterproof pins (135) are retained in the through holes (132) by the pin retention portions (134) so that the waterproof pins (135) corresponding to the terminal reception portions (115) located in use positions can be punched and removed when the pin retention portions (134) are broken by a punching jig (1000) pushed in from the rear; and of the pin retention (135), the pin retention portions (134) retaining adjacent ones of the waterproof pins (135) are disposed to be displaced from each other in the pushing direction (X) of the punching jig (1000).

[6] A mat seal cover (230) of a waterproof connector, including:

a plurality of through holes (232) that correspond to terminal insertion holes (225) of a mat seal (220) corresponding to terminal reception portions (215) of a connector housing (210);

waterproof pins (235) that are provided inside the through holes (232) to close the terminal insertion holes (225); and breakable pin retention portions (234) that are built between the waterproof pins (235) and inner circumferential walls (232*a*) of the through holes (232); wherein:

the waterproof pins (235) are retained in the through holes (232) by the pin retention portions (234) so that the waterproof pins (235) corresponding to the terminal reception portions (215) located in use positions can be punched and removed when the pin retention portions (234) are broken by a punching jig (1000) pushed in from the rear; and coupling portions (234*a*) between the pin retention portions (234) and the inner circumferential walls (232*a*) of the through holes (232) are disposed in bottom faces (236*a*) of concave portions (236) provided in the inner circumferential walls (232*a*) of the through holes (232).

What is claimed is:

1. A mat seal cover of a waterproof connector, wherein the mat seal cover is configured to be attached to a connector housing through a mat seal, the mat seal cover comprising:

a cover body having a plurality of through holes that correspond to terminal insertion holes of the mat seal corresponding to terminal reception portions of the connector housing;

waterproof pins provided inside the through holes of the cover body and configured to close the terminal insertion holes of the mat seal, the waterproof pins terminate inside the through holes at rear ends, and the rear ends include abutment surfaces located inside the through holes; and breakable pin retention portions provided within the through holes and between the waterproof pins and inner circumferential walls of the through holes of the cover body so as to bridge gaps therebetween, wherein the waterproof pins are retained in the through holes by the pin retention portions and the waterproof pins corresponding to the terminal reception portions located in use positions are configured to be punched and removed when the pin retention portions are broken by a punching jig pushed in from a rear of the mat seal cover in a pushing direction; and wherein coupling portions that are arranged between the pin retention portions and the inner circumferential walls of the through holes and that couple the pin retention portions with the inner circumferential walls of the through holes are disposed more closely to a front side in the pushing direction of the punching jig than the abutment surfaces at the rear ends of the waterproof pins against which the punching jig abuts, the pin retention portions include rear end faces located inside the through holes, the rear end faces of the pin retention portions are inclined faces extending from the abutment surfaces toward the coupling portions, and the rear end faces are inclined to the front in the pushing direction of the punching jig.

2. The mat seal cover of a waterproof connector according to claim 1, wherein a pre-shear breaking surface of each of the coupling portions between the pin retention portions and the inner circumferential walls of the through holes has a front end in the pushing direction of the punching jig that is a pointed end shape pointed to the front in the pushing direction.

3. The mat seal cover of a waterproof connector according to claim 1, wherein the pin retention portions retaining adjacent ones of the waterproof pins are disposed to be displaced from each other in the pushing direction of the punching jig.

4. The mat seal cover of a waterproof connector according to claim 1, wherein the coupling portions between the pin retention portions and the inner circumferential walls of the through holes are disposed in bottom faces of concave portions provided in the inner circumferential walls of the through holes.

5. The mat seal cover of a waterproof connector according to claim 1, wherein the pin retention portions are integrally formed as a single piece with each of a respective one of the waterproof pins and the inner circumferential surface of a respective one of the through holes.

6. The mat seal cover of a waterproof connector according to claim 1, wherein each of the through holes includes a pair of openings spaced apart from each other in a pushing direction of a punching jig: and each of the waterproof pins terminates in a respective one of the through holes at the rear end such that the abutment surface is located in the through hole at a location that is spaced away from each of the openings.

7. The mat seal cover of a waterproof connector according to claim 1, wherein each pin retention portion retaining a first one of the waterproof pins is displaced in the pushing direction from each pin retention portion retaining a second one of the waterproof pins, and the second one of the waterproof pins is adjacent to the first one of the waterproof pins.

* * * * *